US011123760B2

(12) United States Patent
Mattson et al.

(10) Patent No.: US 11,123,760 B2
(45) Date of Patent: Sep. 21, 2021

(54) HANDHELD GROUND SPRAYER

(71) Applicant: Graco Minnesota Inc., Minneapolis, MN (US)

(72) Inventors: Barry W. Mattson, Elk River, MN (US); James C. Schroeder, Ramsey, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 99 days.

(21) Appl. No.: 16/341,954

(22) PCT Filed: Oct. 17, 2017

(86) PCT No.: PCT/US2017/056989
§ 371 (c)(1),
(2) Date: Apr. 15, 2019

(87) PCT Pub. No.: WO2018/075526
PCT Pub. Date: Apr. 26, 2018

(65) Prior Publication Data

US 2019/0240690 A1 Aug. 8, 2019

Related U.S. Application Data

(60) Provisional application No. 62/409,630, filed on Oct. 18, 2016.

(51) Int. Cl.
*B05B 12/00* (2018.01)
*B05B 12/14* (2006.01)
(Continued)

(52) U.S. Cl.
CPC ..... *B05B 12/1409* (2013.01); *B05B 7/2472* (2013.01); *B05B 9/01* (2013.01);
(Continued)

(58) Field of Classification Search
CPC ..... B05B 7/2472; B05B 9/01; B05B 9/0861; B05B 11/00; B05B 11/30; B05B 11/3001;
(Continued)

(56) References Cited

U.S. PATENT DOCUMENTS 1,090,863 A * 3/1914 Kelley ..... B05B 11/0078 137/255
4,666,085 A 5/1987 Liaw
(Continued)

FOREIGN PATENT DOCUMENTS

CN 1858476 A 11/2006
CN 101081383 A1 12/2007
(Continued)

OTHER PUBLICATIONS

Extended European Search Report for EP Application No. 17861536.5, dated Apr. 16, 2020, pp. 9.
(Continued)

*Primary Examiner* — Viet Le
(74) *Attorney, Agent, or Firm* — Kinney & Lange, P. A.

(57) ABSTRACT

A ground sprayer includes a front portion and a rear portion. A marking fluid is stored in a fluid reservoir removably mounted in the front portion. A pump disposed in the front portion draws the marking fluid from the fluid reservoir through a manifold, and the pump drives the marking fluid out of a nozzle. An actuator is disposed in the rear portion and can activate the pump based on a command from the user. The rear portion includes a handle such that the user can fully support and operate the ground sprayer with a single hand.

20 Claims, 13 Drawing Sheets

(51) Int. Cl.

| | |
|---|---|
| ***B05B 9/01*** | (2006.01) |
| ***B05B 9/08*** | (2006.01) |
| ***E01C 23/22*** | (2006.01) |
| ***B05B 7/24*** | (2006.01) |
| *B05B 15/16* | (2018.01) |

(52) U.S. Cl.
CPC ..... *B05B 9/0861* (2013.01); *B05B 12/002* (2013.01); *E01C 23/22* (2013.01); *B05B 15/16* (2018.02)

(58) Field of Classification Search
CPC ..... B05B 11/3002; B05B 11/3005; B05B 11/3009; B05B 12/002; B05B 12/1409
See application file for complete search history.

(56) References Cited

U.S. PATENT DOCUMENTS

| | | | | |
|---|---|---|---|---|
| 5,582,350 | A * | 12/1996 | Kosmyna | B05B 15/55 239/345 |
| 6,203,397 | B1 | 3/2001 | Applewhite et al. | |
| 6,296,147 | B1 | 10/2001 | Trocola et al. | |
| 6,723,375 | B2 | 4/2004 | Zeck et al. | |
| 7,121,433 | B2 * | 10/2006 | Nelson | F04D 13/024 222/333 |
| 7,182,280 | B2 | 2/2007 | Ye et al. | |
| 8,025,243 | B2 | 9/2011 | Charpie | |
| 8,047,455 | B2 | 11/2011 | Reedy | |
| 8,413,911 | B2 | 4/2013 | Munn | |
| 8,596,555 | B2 | 12/2013 | Thompson et al. | |
| 8,807,455 | B2 * | 8/2014 | Havlovitz | B05B 9/0426 239/375 |
| 9,114,415 | B2 | 8/2015 | Williams et al. | |
| 9,131,823 | B2 | 9/2015 | Maczuzak | |
| 9,731,308 | B1 * | 8/2017 | Conrad, Jr. | B05D 1/02 |
| 2001/0025859 | A1 | 10/2001 | Dumont | |
| 2002/0134864 | A1 * | 9/2002 | Goodwin | B05B 15/62 239/532 |
| 2007/0278787 | A1 | 12/2007 | Jones et al. | |
| 2008/0083845 | A1 | 4/2008 | Lind et al. | |
| 2010/0272885 | A1 | 10/2010 | Olsson et al. | |
| 2012/0080540 | A1 | 4/2012 | Lind et al. | |
| 2015/0283566 | A1 * | 10/2015 | Kinne | B05B 5/1691 239/690 |
| 2018/0361409 | A1 * | 12/2018 | Beyda | B05B 11/0078 |

FOREIGN PATENT DOCUMENTS

| | | | |
|---|---|---|---|
| CN | 103328107 | A | 9/2013 |
| CN | 103930218 | A | 7/2014 |
| NL | 1022625 | C2 | 11/2004 |

OTHER PUBLICATIONS

International Preliminary Report on Patentability for PCT Application No. PCT/US2017/056989, dated Apr. 23, 2019, pp. 12.
International Search Report and Written Opinion for International Application No. PCT/US2017/056989 dated Feb. 1, 2018, 15 pages.
First Chinese Office Action for CN Application No. 2017800640230, dated Jul. 10, 2020, pp. 23.

* cited by examiner

HANDHELD GROUND SPRAYER

CROSS-REFERENCE TO RELATED APPLICATION(S)

This application claims priority to U.S. Provisional Application No. 62/409,630 filed Oct. 18, 2016, and entitled "HANDHELD GROUND SPRAYER," the disclosure of which is hereby incorporated in its entirety.

BACKGROUND

This disclosure relates generally to sprayers. More specifically, this disclosure relates to handheld ground sprayers.

Ground sprayers spray a fluid, such as paint, onto the ground, such as on roads and grass, to mark the location of various objects, such as underground utilities. Aerosol cans are typically used to apply the marking fluid to the ground. For example, an aerosol can can be mounted to the distal end of a marking stick, and a user can mechanically depress a valve tip of the aerosol can to cause the aerosol can to spray. However, many aerosol products are considered hazardous waste that must be specially treated, which increases disposal costs. Alternatively, the marking fluid has been stored in bags with attached spray tips, and the bags have been mounted in spray guns. The bags are crushed mechanically, such as by a piston or a spring, or pneumatically, such as by compressed air, to build a spray pressure in the bag. A trigger opens the spray valve once the spray pressure has been reached. The bags are disposed of after use, and a new bag of marking fluid must be loaded into the spray device to continue marking.

SUMMARY

According to an aspect of the disclosure, a handheld ground sprayer includes a front portion and a rear portion. The front portion includes a first fluid reservoir configured to store a supply of marking fluid and a pump fluidly connected to the fluid reservoir and configured to draw the marking fluid from the fluid reservoir. The rear portion is connected to the front portion. The rear portion includes a rear housing having a handle, and an actuator supported by the rear housing, the actuator configured to selectively power the pump to drive fluid from the fluid reservoir to the nozzle. The rear portion is configured to be disposed above the forward portion with the ground sprayer is in an operating position.

According to another aspect of the disclosure, a handheld ground sprayer includes a front portion supported by a front housing, a rear portion supported by a rear housing, and a support extending between and connecting the front portion and the rear portion, the support connected to the forward housing and the rear housing. The front portion includes a nozzle configured to spray a marking fluid, a pump fluidly connected to the nozzle and configured to drive the marking fluid through the nozzle, a motor connected to the pump and configured to power the pump, a manifold disposed upstream of the pump and removably mounted to the front housing, and a fluid reservoir removably mounted to the manifold, the fluid reservoir configured to store a supply of the marking fluid. The rear portion includes a handle formed by a portion of the rear housing, a trigger extending from the handle, and a power source configured to activate the motor in response to the trigger being depressed. The pump, the nozzle, and the support are aligned on a spray axis.

DETAILED DESCRIPTION

Figure 1A:
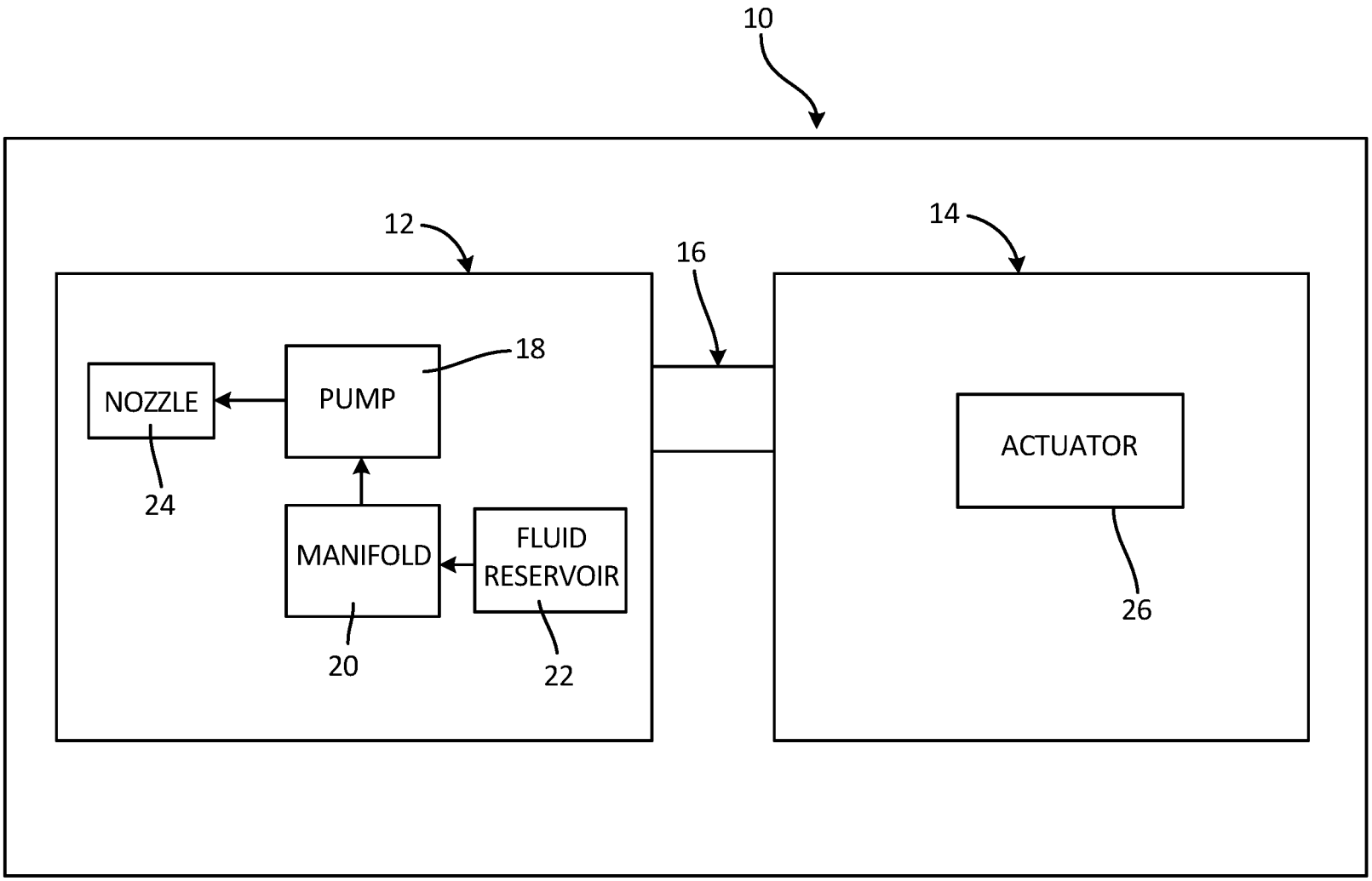
FIG. 1A is a schematic block diagram of a handheld ground sprayer.
Figure 1B:
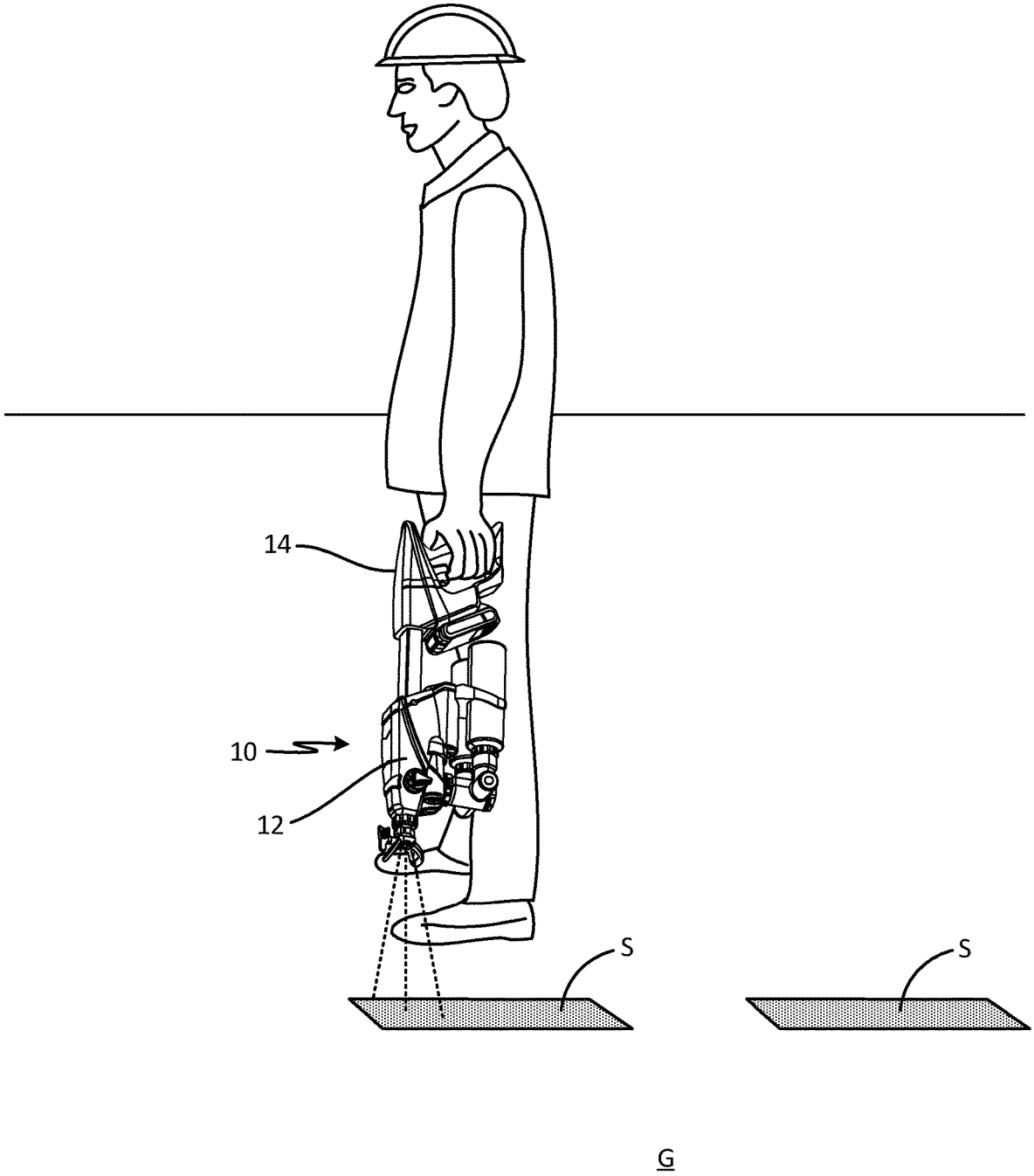
FIG. 1B is a perspective view of a handheld ground sprayer in an operating position.

FIG. 1A is a schematic block diagram of ground sprayer 10. FIG. 1B is a perspective view of ground sprayer 10 in an operating position. Ground sprayer 10 includes front portion 12, rear portion 14, and support 16. Front portion 12 includes pump 18, manifold 20, fluid reservoir 22, and nozzle 24. Rear portion 14 includes actuator 26. Ground sprayer 10 is configured to apply a marking fluid, such as paint and/or other solutions, to mark and/or otherwise coat the ground, such as earth, fields, pavement, flooring, and/or any other desired surface. For example, ground sprayer 10 can be used to apply stripes S of marking fluid to the ground G to indicate the location of underground objects, such as utilities. It is understood, however, that ground sprayer 10 can be used to apply any desired fluid, such as coatings, water, oil, stains, finishes, solvents, and fillers, among others.

Support 16 extends between and connects front portion 12 and rear portion 14. In some examples, front portion 12 and rear portion 14 can be integrally formed such that support 16 can be a common housing supporting the components of both front portion 12 and rear portion 14. In other examples, support 16 can be a bridge extending between and physically connecting front portion 12 and rear portion 14. Support 16 can be extendable such that the distance between front portion 12 and rear portion 14 is adjustable.

Front portion 12 includes components that contain, route, pump, and/or spray the marking fluid. Front portion 12 can include a front housing to support, and in some cases house, the various components of front portion 12. Rear portion 14 can similarly include a rear housing to support, and in some cases house, the various components of rear portion 14, such as actuator 26. The front housing and the rear housing isolate the components in front portion 12 from the components in rear portion 14.

Pump 18 is disposed in front portion 12. Manifold 20 is fluidly connected to pump 18. Fluid reservoir 22 is fluidly connected to manifold 20. In some examples, fluid reservoir 22 can be removably attached to manifold 20. For example, fluid reservoir 22 can be attached to manifold 20 by a bayonet mount, a press-fit connection, a threaded connection, or in any other suitable manner Nozzle 24 is disposed in front portion 12 and is fluidly connected to pump 18.

Fluid reservoir 22 is configured to store a volume of a marking fluid prior to application by ground sprayer 10. In some examples, the fluid reservoir 22 can be a refillable container that can be flexible or rigid. Fluid reservoir 22 can be transparent to allow a user to visually determine the volume of marking fluid remaining in fluid reservoir 22. Manifold 20 fluidly connects fluid reservoir 22 and pump 18, and pump 18 draws the marking fluid from fluid reservoir 22 through manifold 20. Manifold 20 can be removably connected to pump 18. In some examples, front portion 12 can receive multiple, interchangeable manifolds 20. For example, a first manifold can be configured to receive multiple fluid sources and a second manifold can be configured to receive a single fluid source. Both the first manifold and the second manifold can have the same connector to allow both manifolds to connect to pump 18. As such, the first manifold and the second manifold can be interchanged to facilitate conversion of ground sprayer 10 between a single-reservoir configuration and a multiple-reservoir configuration. For example, manifold 20 can be connected within front portion 12 by a bayonet mount, a press-fit connection, a threaded connection, or in any other suitable manner.

Pump 18 is configured to draw the marking fluid from fluid reservoir 22 and to drive the marking fluid through nozzle 24. Pump 18 can be a piston pump, a diaphragm pump, or any other suitable positive-displacement pump.

Actuator 26 is disposed in rear portion 14 and selectively powers pump 18 to activate and deactivate pump 18 during operation of ground sprayer 10. For example, actuator 26 can include a power source and a trigger. The user can depress the trigger to cause the power source to provide power to pump 18, thereby activating pump 18. In some examples, actuator 26 can provide power to a motor, such as an electric or pneumatic motor, connected to and configured to drive pump 18. For example, actuator 26 can be connected to pump 18 by a wire extending between rear portion 14 and front portion 12 through support 16, and actuator 26 can close a circuit in response to the trigger being depressed, thereby providing electrical power to the motor via the wire. In other examples, actuator 26 can open a compressed air line in response to the trigger being depressed, thereby providing compressed air to drive the motor.

In an operational position, shown in FIG. 1B, sprayer axis A-A of ground sprayer 10 is oriented perpendicular to the ground. Rear portion 14 is disposed above front portion 12 with nozzle 24 aimed at the ground. Fluid reservoir 22 is disposed above manifold 20 such that the flow of marking fluid into manifold 20 is gravity assisted. During operation, the components that contain, route, pump, and/or spray the marking fluid are thus disposed below any electrical components, such as actuator 26, to minimize the chance of electrical shorting. In addition, in examples where front portion 12 includes the front housing and rear portion 14 includes the rear housing, the independent housings further isolate the components in front portion 12 from the components in rear portion 14.

To apply the marking fluid, the user can grasp rear portion 14 and activate pump 18 with actuator 26. For example, rear portion 14 can include a handle that the user can grasp with a single hand, and the user can pull the trigger on the handle. Pump 18 draws the marking fluid into pump 18 from fluid reservoir 22 through manifold 20. Pump 18 drives the marking fluid downstream through nozzle 24 at high pressures, such as 1000-3000 psi, and nozzle 24 can atomize the marking fluid for application on the ground. As such, pump 18 produces an airless spray of marking fluid.

Ground sprayer 10 provides significant advantages. Front portion 12 is fluidly isolated from rear portion 14. Fluidly isolating front portion 12, which can include the marking fluid, from rear portion 14, which can include electrical components, minimizes the chance of electric shorting. In the operational position, the components of front portion 12 that contain, route, pump, and/or spray the marking fluid are disposed below rear portion 14, and are oriented such that the flow of marking fluid is gravity-assisted. Fluid reservoir 22 is removable from manifold 20 such that various marking fluids can be easily changed into ground sprayer 10 by disconnecting one fluid reservoir 22 and attaching another fluid reservoir 22. Moreover, manifold 20 is removable such that ground sprayer 10 can be easily converted between a single-marking fluid configuration and a multiple-marking fluid configuration by detaching one manifold 20 and attaching another manifold 20. In addition, ground sprayer 10 provides an airless spray of marking fluid, thereby eliminating propellants.

Figure 2A:
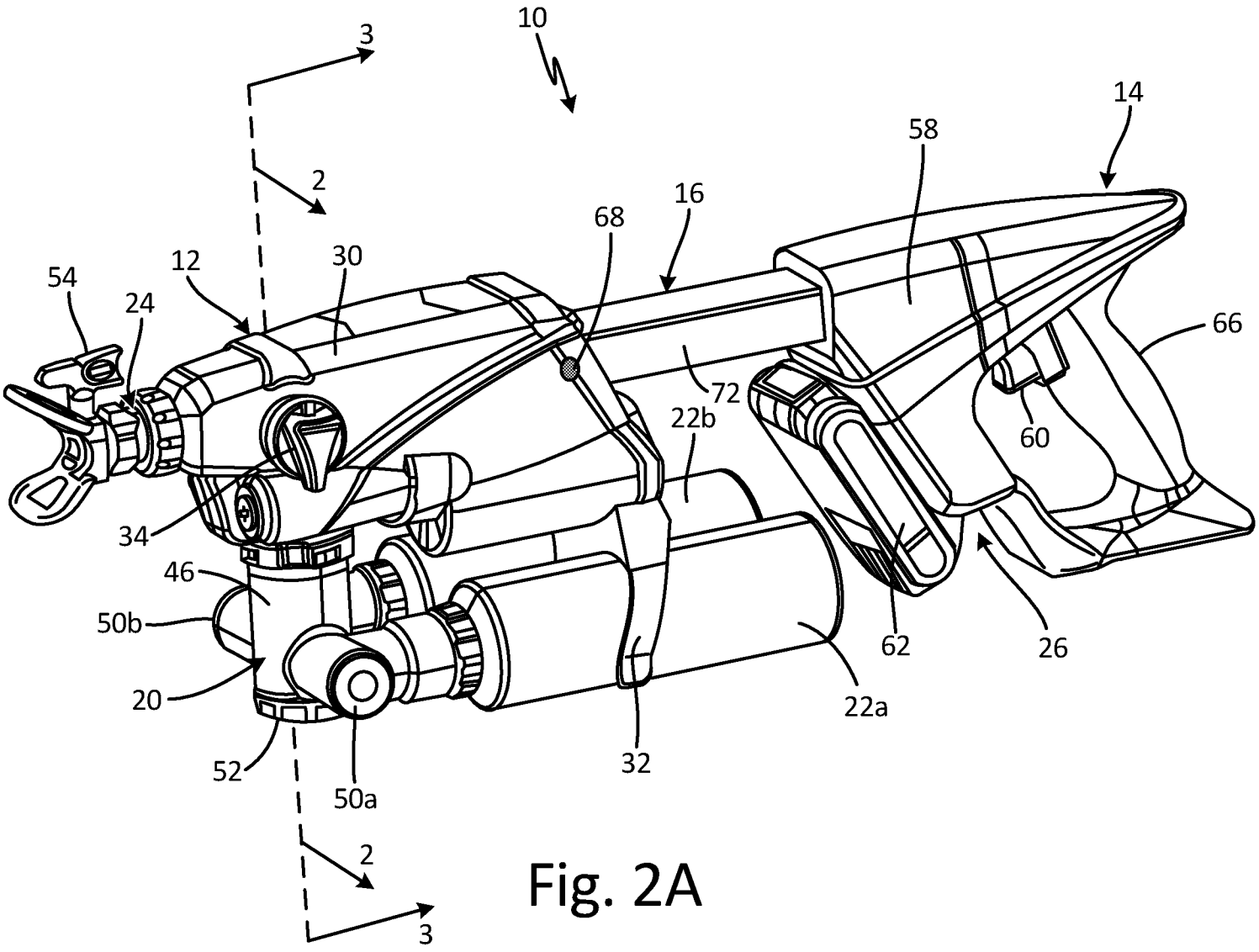
FIG. 2A is an isometric view of a handheld ground sprayer with multiple fluid reservoirs.
Figure 2B:
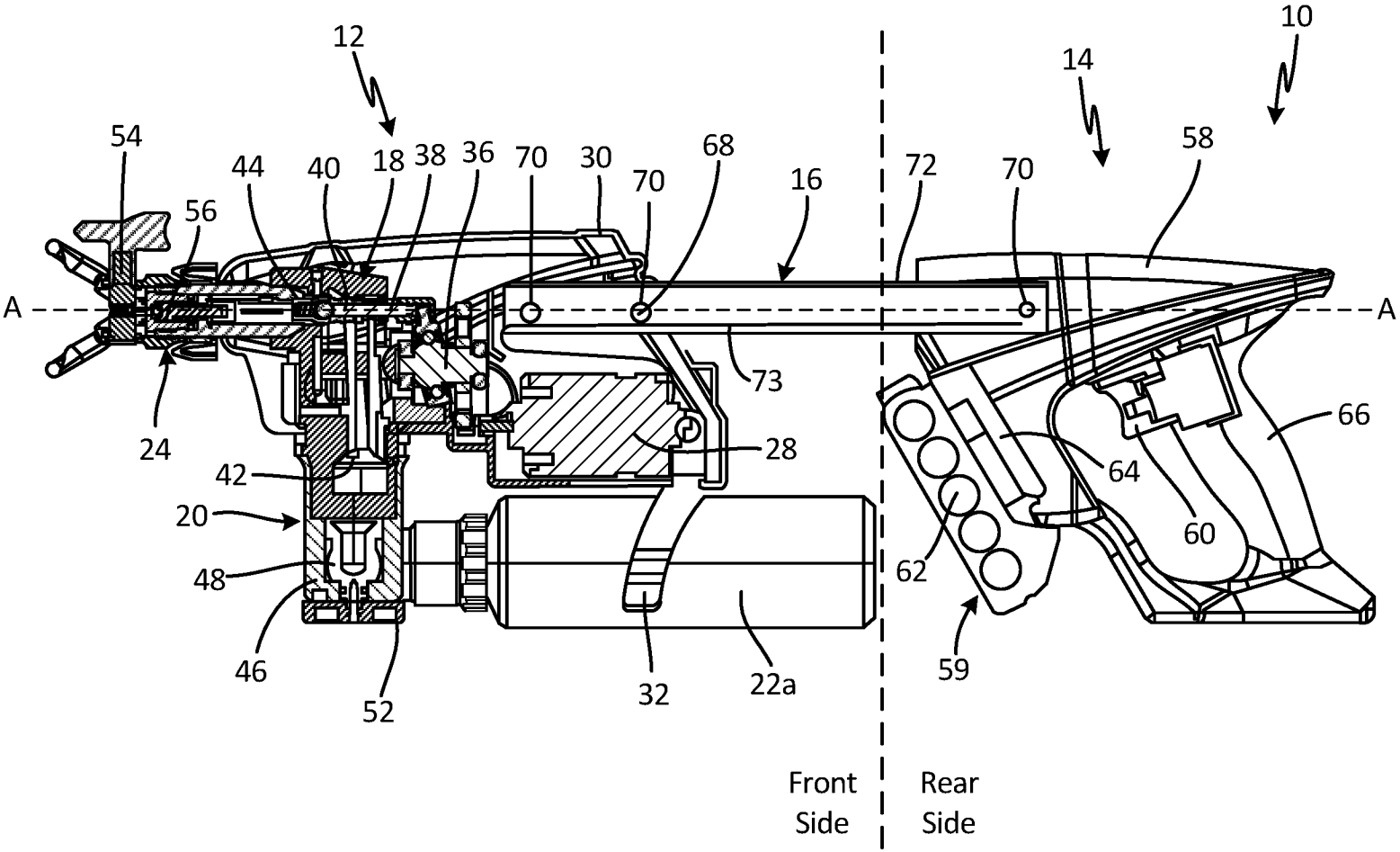
FIG. 2B is a cross-sectional view of the handheld ground sprayer of FIG. 2A taken along line 2-2 in FIG. 2A.

FIG. 2A is an isometric view of ground sprayer 10. FIG. 2B is a cross-sectional view of ground sprayer 10 taken along line 2-2 in FIG. 2A. FIGS. 2A-2B will be discussed together. Ground sprayer 10 includes front portion 12, rear portion 14, and support 16. Front portion 12 includes pump 18, manifold 20, fluid reservoirs 22*a* and 22*b*, nozzle 24, motor 28, front housing 30, reservoir support 32, and control switch 34. Pump 18 includes drive 36, piston 38, cylinder 40, pump intake 42, and check valve 44. Manifold 20 includes manifold housing 46, selector valve 48, end caps 50*a* and 50*b*, and selector knob 52. Nozzle 24 includes spray tip 54 and tip valve 56. Rear portion 14 includes actuator 26 and rear housing 58. Actuator 26 includes trigger 60, battery 62, and control board 64. Rear housing 58 includes handle 66. Support 16 includes locating pin 68, locating apertures 70, and bridge portion 72.

Rear housing 58 supports actuator 26. Handle 66 is formed by rear housing 58 and can be grasped by a user. Trigger 60 extends from handle 66 and is configured to allow the user to selectively actuate pump 18. In some examples, rear housing 58 can be of a clamshell configuration that structurally supports all components of rear portion 14.

Battery 62 is mounted on rear housing 58. While actuator 26 is shown as including battery 62, any suitable source for powering pump 18 can be utilized, such as an electrical cord and plug for plugging into an electrical outlet, or a compressed air source, such as a tank mounted on rear housing 58. Battery 62 can be a lithium ion-type or other type of battery. Battery 62 can interface with the rear housing 58 both to make an electrical connection for powering the ground sprayer 10 and to lock battery 62 in place by structurally fixing battery 62 to the rear portion 14. After use, battery 62 can be slid out of the locked arrangement with rear housing 58 for removal, recharging, and recoupling with rear portion 14. Control board 64 is disposed in rear housing 58 and includes circuitry for managing power from battery 62. In some examples, control board 64 can receive an input from trigger 60, which can include opening or closing a circuit depending on the positon of trigger 60. Wires 73 are connected to control board 64 and extend to front portion 12 through support 16. Wires 73 can be attached to motor 28 to provide power to motor 28 from battery 62.

Support 16 extends between and connects front portion 12 and rear portion 14. Bridge portion 72 is attached to front housing 30 and to rear housing 58 and provides a physical connection between front portion 12 and rear portion 14. Bridge portion 72 can be an elongate hollow member, and bridge portion 72 can have any desired cross-sectional shape, such as circular, oval, rectangular, or square, among others. Bridge portion 72 can be formed of any suitable material for supporting front portion 12 relative to rear portion 14, such as metal or a polymer.

Locating apertures 70 extend through bridge portion 72 and are configured to receive locating pin 68 to secure front portion 12 at a desired distance from rear portion 14. To adjust the distance, locating pin 68 can be pulled out of one locating aperture 70 and front portion 12 can be pushed towards or pulled from rear portion 14. Locating pin 68 is inserted into another locating aperture 70 to secure front portion 12 relative to rear portion 14. While bridge portion 72 is shown as including three locating holes, it is understood that bridge portion 72 can include as many or as few locating holes as desired. Moreover, while locating pin 68 is illustrated as extending within front portion 12, it is understood that locating pin 68 can be located in rear portion 14. In some examples, both front portion 12 and rear portion 14 can include a locating pin 68 such that both front portion 12 and rear portion 14 can slide along a length of bridge portion 72.

Pump 18 is supported by and at least partially disposed in front housing 30. Pump 18 can include a pump housing that is supported by front housing 30 and provides the flowpath for the marking fluid to flow through pump 18. Piston 38 extends into cylinder 40 and is configured to reciprocate within cylinder 40 to drive the marking fluid. Drive 36 is attached to piston 38 and to motor 28. Pump intake 42 is configured to receive the marking fluid from manifold 20 and to provide the marking fluid to cylinder 40. Check valve 44 is disposed at an outlet of cylinder 40. Drive 36 is configured to pull piston 38 through a suction stroke, whereby piston 38 draws the marking fluid into cylinder 40 through pump intake 42, and to push piston 38 through a pressure stroke, whereby piston 38 drives the marking fluid downstream through check valve 44. While pump 18 is described as a piston pump, it is understood that pump 18 can be any suitable positive-displacement pump, such as a diaphragm pump.

Nozzle 24 is supported by front housing 30 and is disposed downstream of check valve 44. Nozzle 24 is fluidly connected to pump 18 and is configured to receive the marking fluid from pump 18. Tip valve 56 receives the marking fluid from pump 18 and the marking fluid is sprayed out of front portion 12 through spray tip 54. Tip valve 56 can be pressure activated such that tip valve 56 opens only when pump 18 is activated. Spray tip 54 includes an orifice to atomize the marking fluid and to generate a desired spray pattern. For example, spray tip 54 can include a carbide orifice configured to provide a fan pattern. In some examples, spray tip 54 is reversible such that spray tip 54 can be rotated between an operational position and a priming and/or cleaning position. Control switch 34 extends through front housing 30 and can be utilized to switch ground sprayer 10 between a pump priming mode of operation and a spray mode of operation.

Motor 28 is supported by front housing 30. Motor 28 can be disposed in a motor housing separate from and supported by front housing 30. Motor 28 is connected to drive 36 and is configured to provide rotational motion to drive 36. Motor 28 can be connected to drive 36 in any suitable manner, such as a toothed gear connection. Drive 36 is configured to convert the rotational motion from motor 28 into linear, reciprocating motion of piston 38. In some examples, drive 36 is a wobble drive, but it is understood that drive 36 can be of any suitable configuration for converting the rotational output of motor 28 into linear, reciprocating motion, such as various cranks, such as a scotch-yolk, for example. Motor 28 can be of any suitable configuration for powering drive 36. For example, motor 28 can be a gas motor, a pneumatic motor, a brushed electric motor, or a brushless electric motor, among others.

Manifold 20 is supported on front portion 12. Manifold housing 46 is connected to front housing 30. Manifold housing 46 can be removably attached to forward housing in any desired manner, such as a bayonet mount, a press-fit connection, or a threaded connection, for example. End cap 50*a* and end cap 50*b* are at least partially disposed in manifold housing 46. End cap 50*a* and end cap 50*b* can seal passageways in manifold housing 46. Selector valve 48 is disposed within manifold housing 46 and is configured to fluidly connect one of fluid reservoir 22*a* and fluid reservoir 22*b* to pump 18, while fluidly disconnecting the other of fluid reservoir 22*a* and fluid reservoir 22*b* from pump 18. For example, selector valve 48 can provide a flow path between fluid reservoir 22*a* and pump 18 in a first position, and can provide a flow path between fluid reservoir 22*b* and pump 18 in a second position. Selector knob 52 is connected to selector valve 48 and can be manipulated to cause selector valve 48 to fluidly connect one of fluid reservoir 22*a* and fluid reservoir 22*b*. For example, selector knob 52 can be rotated to cause selector valve 48 to shift between the first position and the second position.

Fluid reservoir 22*a* and fluid reservoir 22*b* are attached, and fluidly connected, to manifold 20. Both fluid reservoirs 22*a* and 22*b* are configured to store a supply of the marking fluid for application during operation. In some examples, fluid reservoir 22*a* can store a first marking fluid and fluid reservoir 22*b* can store a second marking fluid different than the first marking fluid. For example, the first marking fluid can be a different color paint than the second marking fluid. Each of fluid reservoir 22*a* and 22*b* is removably attached to manifold housing 46, such that each of fluid reservoir 22*a* and 22*b* is individually removable from manifold housing 46. Fluid reservoirs 22*a* and 22*b* can be attached to manifold housing 46 in any suitable manner, such as a bayonet mount, a press fit connection, or a threaded connection, among others. In some examples, an internal, one-way valve configured to allow the marking fluid to flow downstream to manifold 20 while preventing the marking fluid from backflowing into fluid reservoirs 22*a* and 22*b*, respectively, can be disposed in manifold housing 46. In some examples, an internal, one-way valve can be disposed in manifold housing 46 between fluid reservoir 22*a* and selector valve 48, and another internal, one-way valve can be disposed in manifold housing 46 between fluid reservoir 22*b* and selector valve 48.

As shown, fluid reservoirs 22*a* and 22*b* can be elongate. In some examples, fluid reservoirs 22*a* and 22*b* can be cylindrical, polymer bottles. In some examples, fluid reservoirs 22*a* and 22*b* can be transparent such that the user can visually determine the amount of marking fluid available and the color of the marking fluid in that particular fluid reservoir 22. In some examples, fluid reservoirs 22*a* and 22*b* can be formed from a rigid material such that fluid reservoirs 22*a* and 22*b* do not collapse or otherwise shrink as the marking fluid is drawn out of fluid reservoirs 22*a* and 22*b* during operation, and fluid reservoirs 22*a* and 22*b* can include a bleeder valve or any other suitable valve to vent fluid reservoirs 22*a* and 22*b* during operation. In other examples, fluid reservoirs 22*a* and 22*b* can include a collapsible bag filled with the marking fluid and configured to shrink as the marking fluid is withdrawn.

Reservoir support 32 is supported on front housing 30. Reservoir support 32 is configured to provide stabilizing support to fluid reservoir 22*a* and fluid reservoir 22*b*. In the example shown, reservoir support 32 includes two pairs of arms that extend partially around and hug fluid reservoirs 22*a* and 22*b*, respectively. Fluid reservoirs 22*a* and 22*b* can slide and/or snap into reservoir support 32. For example, reservoir support 32 can be made from a flexible plastic or metal such that the arms can flex as a fluid reservoir 22 is inserted, and the arms can snap back into position to clamp on fluid reservoir 22 when fluid reservoir 22 is fully installed. It is understood, however, that reservoir support 32 can be of any suitable configuration for providing additional support to fluid reservoirs 22*a* and 22*b*, such as an adjustable strap, a ring that a fluid reservoir 22 can be slid into, or any other desired configuration. Reservoir support 32 can be integrally formed as a single support assembly or can include multiple, individual components. For example, reservoir support 32 can include a first pair of arms separate from a second pair of arms, with each pair of arms individually mounted on front housing 30.

Nozzle 24 and piston 38 are located on spray axis A-A of ground sprayer 10. In the embodiment shown, spray axis A-A extends through and is coaxial with bridge portion 72. With ground sprayer 10 in an operational position (shown in FIG. 1B), spray axis A-A is preferably perpendicular to the ground. During operation, bridge portion 72 is visible to the user, while a direct line-of-sight to nozzle 24 can be obstructed. Having bridge portion 72 and nozzle 24 disposed coaxially allows bridge portion 72 to function as a sight that provides the user with a visual aid for accurately aiming and applying the marking fluid.

During operation, the user can grasp handle 66 with a single hand to fully support ground sprayer 10 and apply the marking fluid to the ground. When ground sprayer 10 is in an operational orientation, rear portion 14 is disposed above front portion 12 and spray axis A-A is or is about perpendicular to the ground. The user can select the marking fluid to be applied by manipulating selector knob 52 to rotate selector valve 48 to the appropriate position to connect one of fluid reservoir 22*a* and fluid reservoir 22*b* to pump 18. With the desired fluid reservoir 22 connected, the user can depress trigger 60 to activate ground sprayer 10. Depressing trigger 60 can open or close a circuit on control board 64. In response to the circuit opening or closing, control board 64 can provide power to motor 28 from battery 62 via wire 73. The power causes motor 28 to rotate and to power drive 36. Drive 36 converts the rotational motion of motor 28 into linear, reciprocating motion of piston 38. As piston 38 is drawn rearwards through a suction stroke, a vacuum is formed in cylinder 40, and the vacuum draws marking fluid into cylinder 40 from the connected fluid reservoir 22. The marking fluid flows out of the selected fluid reservoir 22, flows through selector valve 48, and enters pump 18 through pump intake 42.

When piston 38 completes the suction stroke, drive 36 drives piston 38 through a pressure stroke. During the pressure stroke, piston 38 is driven in the forward direction, towards nozzle 24, and piston 38 forces the marking fluid out of cylinder 40 through check valve 44. The pressure generated by piston 38 causes the marking fluid to flow through tip valve 56 and to spray out of spray tip 54. As such, ground sprayer 10 is configured generate an airless spray of marking fluid. Ground sprayer 10 draws the marking fluid from fluid reservoir 22 and drives the marking fluid out of nozzle 24 without requiring a propellant. While pump 18 is described as including piston 38, it is understood that pump 18 can be of any suitable configuration for producing an airless spray of marking fluid. For example, pump 18 can include a diaphragm for driving the marking fluid.

In the operational position, rear portion 14 is disposed above front portion 12. The components that contain, route, pump, and/or spray the marking fluid are located in front portion 12, while electrical components are located in rear portion 14, thereby minimizing the chance of an electrical short occurring. During operation, the marking fluid is confined to front portion 12, such that the marking fluid is isolated from any electronic components within rear portion 14 and such that the marking fluid would have to flow against gravity to reach rear portion 14. As discussed above, motor 28 can be disposed in a motor housing to provide an additional barrier between the flow of the marking fluid and motor 28. Moreover, motor 28 is mounted within front portion 12 such that motor 28 is disposed vertically above the fluid flowpath through front portion 12 when ground sprayer 10 is in the operational position. The marking fluid would thus have to flow against gravity to flow to motor 28.

To apply a stripe of the marking fluid to the ground, the user typically grasps handle 66 with one hand, depresses trigger 60, and swings ground sprayer 10 on a vertical plane. Ground sprayer 10 provides the spray of the marking fluid out of nozzle 24. The components of ground sprayer 10 are arranged to balance ground sprayer 10 when operated by the user. Pump 18, motor 28, and fluid reservoirs 22*a* and 22*b* are disposed in front portion 12, which is closest to the ground during operation. As such, the heaviest components of ground sprayer 10 are disposed furthest away from the user, such that the momentum of swinging ground sprayer 10 facilitates an easy-to-maintain pendulum motion for the user.

Ground sprayer 10 provides significant advantages. Front portion 12 and rear portion 14 are fluidly isolated such that the electronic components of ground sprayer 10 are isolated from the marking fluid. Fluid reservoirs 22 are removable from manifold 20 and can be refilled and replaced. As such, a single ground sprayer 10 can be used to apply a variety of marking fluids by simply changing the fluid supply. Where manifold 20 is configured to receive multiple fluid reservoirs 22, the supply of marking fluid can be changed by simply twisting selector knob 52. In addition, the supply of marking fluid, in fluid reservoirs 22, is independent of the components that deliver the marking fluid, such as pump 18 and nozzle 24. Having the delivery independent of the supply allows the user to change marking fluids easily and efficiently. The downtime of ground sprayer 10 is thereby reduced.

Figure 3A:
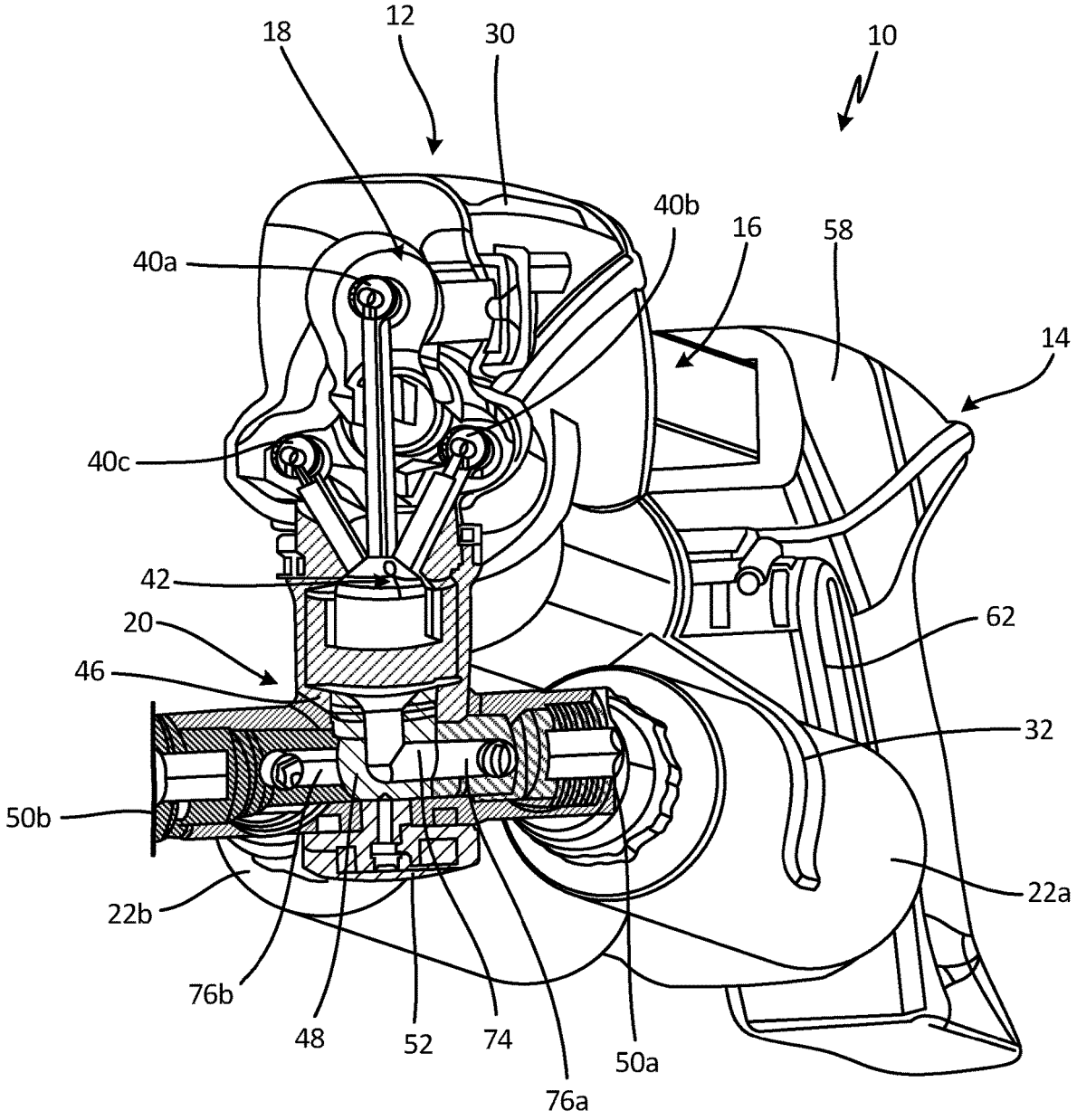
FIG. 3 is a cross-sectional view of the handheld ground sprayer of FIG. 2A taken along line 3-3 in FIG. 2A.

FIG. 3 is a cross-sectional view of ground sprayer 10 taken along line 3-3 in FIG. 2A. Ground sprayer 10 includes front portion 12, rear portion 14, and support 16. Pump 18, fluid reservoirs 22*a* and 22*b*, front housing 30, manifold 20, and reservoir support 32 of front portion 12 are shown. Rear housing 58 and battery 62 of rear portion 14 are shown. Cylinders 40*a*-40*c* and pump intake 42 of pump 18 are shown. Manifold 20 includes manifold housing 46, selector valve 48, end cap 50*a*, end cap 50*b*, and selector knob 52. Selector valve 48 includes fluid passage 74. End cap 50*a* includes channel 76*a*, and end cap 50*b* includes channel 76*b*.

Manifold housing 46 is removably connected to front housing 30 to secure manifold 20 within front portion 12.

Fluid reservoir 22*a* is attached to manifold 20 and is configured to store a first supply of the marking fluid. Fluid reservoir 22*b* is attached to manifold 20 and is configured to store a second supply of the marking fluid. Reservoir support 32 is attached to front portion 12 and is configured to provide support to fluid reservoir 22*a* and fluid reservoir 22*b*. Pump 18 is fluidly connected to manifold 20 and is configured to draw the marking fluid from manifold 20 and into cylinders 40*a*-40*c*, and to drive the marking fluid downstream from cylinders 40*a*-40*c* for application to the ground. Pump intake 42 is adjacent manifold 20 and is configured to receive the marking fluid from manifold 20 and to provide the marking fluid to cylinders 40*a*-40*c*. While pump 18 is shown as including three cylinders 40*a*-40*c*, and thus three pistons, it is understood that pump 18 can include any desired number of pistons and cylinders. In some examples, pump 18 includes a single piston and cylinder.

End cap 50*a* extends into manifold housing 46 and is configured to receive the marking fluid from fluid reservoir 22*a*. End cap 50*a* abuts selector valve 48. Channel 76*a* extends through end cap 50*a* and provides a flow path for the marking fluid to flow through end cap 50*a*. End cap 50*b* extends into manifold housing 46 and is configured to receive the marking fluid from fluid reservoir 22*b*. End cap 50*b* abuts selector valve 48. Channel 76*b* extends through end cap 50*b* and provides a flow path for the marking fluid to flow through end cap 50*b*. End cap 50*a* and end cap 50*b* can be secured to manifold housing 46 in any desired manner, such as with interlocking threading or by a press-fit connection, among others.

Selector valve 48 is disposed in manifold housing 46 between end cap 50*a* and end cap 50*b*. Selector knob 52 is connected to selector valve 48 and is configured to manipulate an orientation of selector valve 48 within manifold housing 46. Fluid passage 74 extends through selector valve 48 and is configured to receive the marking fluid from channel 76*a* or channel 76*b*, depending on the orientation of selector valve 48. Fluid passage 74 is curved, such that the marking fluid flows through a curved pathway between fluid reservoir 22 and pump 18.

To connect the first supply of the marking fluid, selector knob 52 is turned until selector valve 48 is in a first position where fluid passage 74 is aligned with channel 76*a*. With fluid passage 74 aligned with channel 76*a*, fluid reservoir 22*a* is fluidly connected to pump 18. As such, activating ground sprayer 10 causes pump 18 to draw the marking fluid from fluid reservoir 22*a*. When the second supply of marking fluid is desired, selector knob 52 is turned until selector valve 48 is in a second position where fluid passage 74 is aligned with channel 76*b*. Selector valve 48 is configured such that fluid passage 74 can receive the marking fluid from one of channel 76*a* or channel 76*b*, but not both simultaneously. While selector valve 48 can rotate 180 degrees to align with one of channels 76*a* and 76*b* it is possible that three channels associated with three reservoirs (i.e. with three different paint colors) can be employed such that only a 120 degree rotation is required to change alignment with the input channels to change between fluid supplies. Four channels and reservoirs are also possible. It is also noted that selector valve 48 can be rotated out of alignment with both channel 76*a* and channel 76*b* to prevent any marking fluid from flowing to the pump intake 42.

Manifold 20 provides significant advantages. Selector valve 48 allows the user to selectively connect a desired supply of marking fluid. The user can rotate selector knob 52 to connect the one supply of marking fluid, increasing the efficiency and speed of the marking process. For example, different underground utilities are marked with different colors of paint. A first color paint can be provided in fluid reservoir 22*a* and a second color paint can be provided in fluid reservoir 22*b*. When the user is marking a second utility type, the user can simply twist selector knob 52 to connect the new color and can continue with marking the second utility instead of stopping the marking process to switch to a new color paint. The user can then switch back to the first color by simply turning the knob back to the first position.

Figure 4:
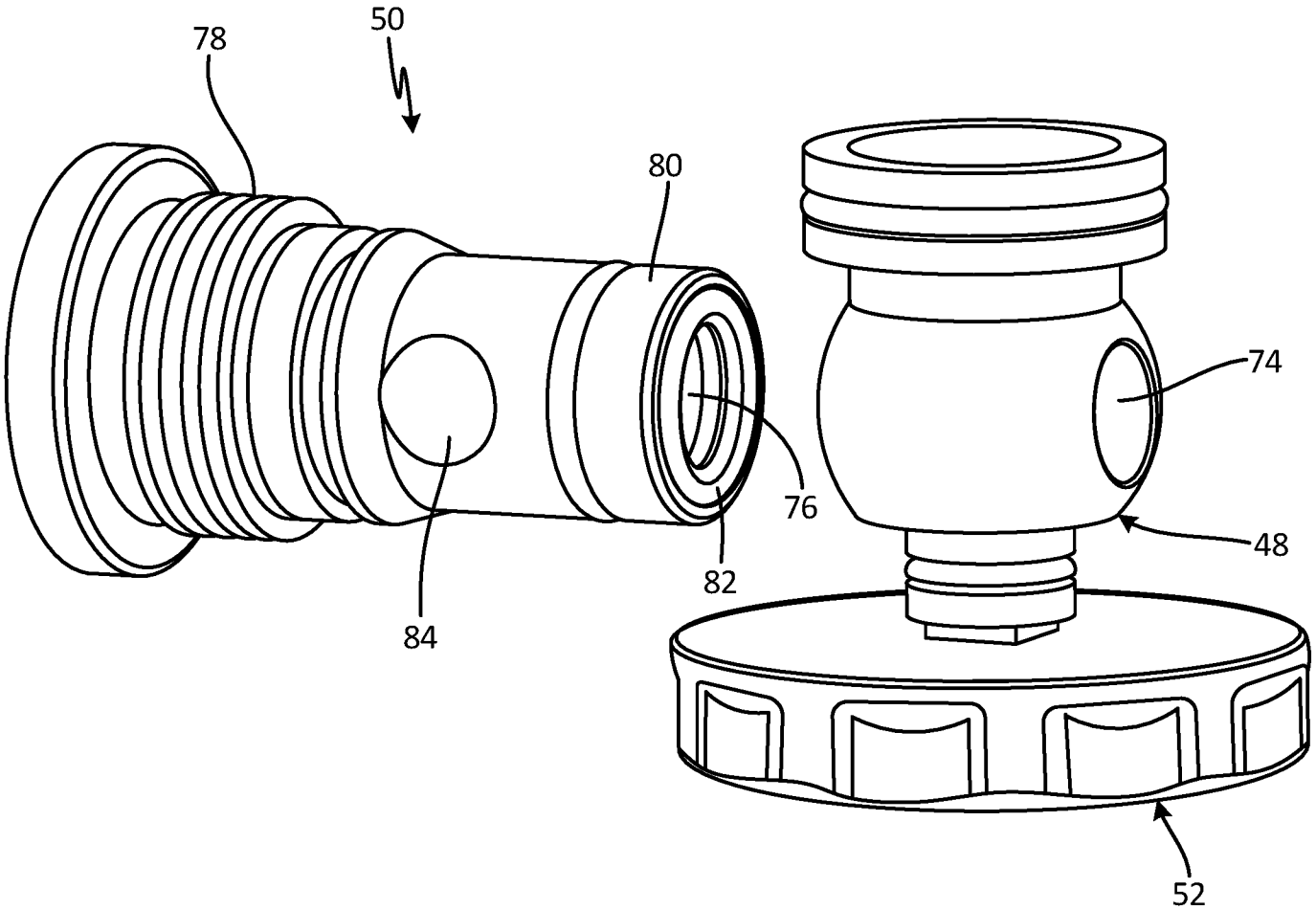
FIG. 4 is an exploded view of a manifold valve and end cap.

FIG. 4 is a partially exploded, isolated view of a single end cap 50, selector valve 48, and selector knob 52. End cap 50 includes channel 76, attachment portion 78, inner end 80, seal 82, and cross-bore 84. Selector valve 48 includes fluid passage 74. Seal 82 is disposed on inner end 80 of end cap 50. Inner end 80 abuts selector valve 48 and seal 82 provides a fluid tight seal between selector valve 48 and inner end 80. Attachment portion 78 is configured to attach to manifold housing 46 (shown in FIGS. 2A-3) to secure end cap 50 to manifold housing 46. In the illustrated example, attachment portion 78 includes threading configured to mate with threading on manifold housing 46. It is understood, however, that attachment portion 78 can be of any suitable configuration for securing end cap 50 to manifold 20, such as a press fit connection, for example. Channel 76 extends through inner end 80 of end cap 50 and is configured to provide a flowpath for marking fluid to flow to selector valve 48. Cross-bore 84 extends through end cap 50 and provides an entry for marking fluid to enter channel 76 from the fluid reservoir. Fluid passage 74 extends through selector valve 48 and is configured to receive the marking fluid from channel 76. Selector knob 52 is attached to selector valve 48 and can be turned to manipulate a position of selector valve 48 to selectively connect fluid passage 74 to different sources of the marking fluid.

Inner end 80 of end cap 50 abuts the body of selector valve 48, with seal 82 providing a fluid-tight seal between end cap 50 and selector valve 48. The body of selector valve 48 can be round to facilitate sealing between inner end 80 and selector valve 48. During operation, channel 76 of end cap 50 receives marking fluid from a fluid source, such as fluid reservoir 22 (best seen in FIG. 2A), fluid reservoir 22' (FIGS. 6A-6B), fluid reservoir 22" (FIG. 7), and/or fluid reservoir 22''' (FIG. 8). To connect channel 76 to pump 18 (best seen in FIG. 2B), selector valve 48 can be rotated, by grasping and twisting selector knob 52, for example, such that fluid passage 74 is aligned with channel 76. With fluid passage 74 aligned with channel 76, the fluid source is fluidly connected to the pump assembly through end cap 50 and selector valve 48.

Figure 5:
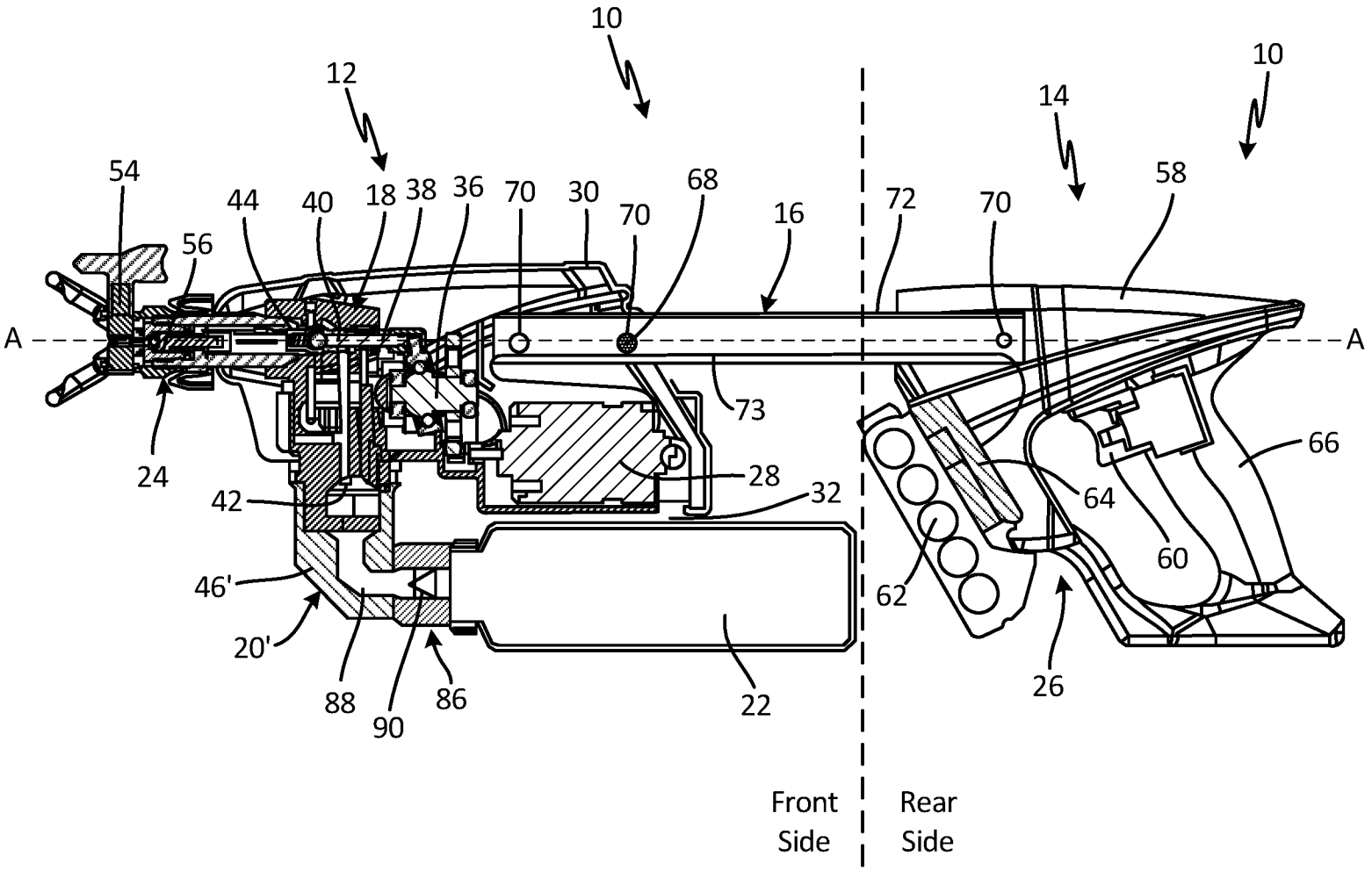
FIG. 5 is a cross-sectional view of a handheld ground sprayer with a single fluid reservoir.

FIG. 5 is a cross-sectional view of ground sprayer 10. Ground sprayer 10 includes front portion 12, rear portion 14, and support 16. Front portion 12 includes pump 18, manifold 20', fluid reservoir 22, nozzle 24, motor 28, front housing 30, and reservoir support 32, and reservoir connector 86. Pump 18 includes drive 36, piston 38, cylinder 40, pump intake 42, and check valve 44. Manifold 20' includes manifold housing 46' and fluid passage 88. Reservoir connector 86 includes one-way valve 90. Nozzle 24 includes spray tip 54 and tip valve 56. Rear portion 14 includes actuator 26 and rear housing 58. Actuator 26 includes trigger 60, battery 62, and control board 64. Rear housing 58 includes handle 66. Support 16 includes locating pin 68, locating apertures 70, and bridge portion 72.

As discussed above, support 16 extends between and connects front portion 12 and rear portion 14. Bridge portion 72 is attached to front housing 30 and rear housing 58, and locating pin 68 extends through locating apertures 70 to lock a position of front housing 30 relative to rear housing 58. Handle 66 is integral with rear housing 58, and rear housing 58 supports actuator 26. Battery 62 and control board 64 are configured to provide power to motor 28 via wire 73 in response to trigger 60 being depressed by the user. Motor 28 is disposed in front portion 12. Motor 28 interfaces with and is configured to provide rotational power to drive 36. Drive 36 converts the rotational power of motor 28 into linear, reciprocating motion of piston 38. Piston 38 extends from drive 36 into cylinder 40. Nozzle 24 is disposed downstream from piston 38 and is fluidly connected to pump 18. Pump intake 42 is fluidly connected to cylinder 40 and configured to provide the marking fluid to cylinder 40.

Manifold 20' is fluidly connected to pump 18 and to fluid reservoir 22. Manifold housing 46 is removably attached to front housing 30. Manifold housing 46' can be attached to front housing 30 by any suitable connection, such as a bayonet-type connection, a threaded connection, or a press-fit connection, among others. Fluid passage 88 extends through manifold housing 46' and is configured to provide a fluid flowpath for the marking fluid to flow from fluid reservoir 22 to pump 18.

Reservoir connector 86 extends between fluid reservoir 22 and manifold 20'. Reservoir connector 86 is removably attached to manifold housing 46' and to fluid reservoir 22. Reservoir connector 86 can be attached to fluid reservoir 22 and to manifold housing 46' in any suitable manner, such as a bayonet mount, a threaded connection, or a press-fit connection. One-way valve 90 is disposed in reservoir connector 86 and is configured to prevent the marking fluid from backflowing into reservoir 92. While one-way valve 90 is shown in reservoir connector 86, it is understood that one-way valve 90 can be disposed in fluid passage 88'. While reservoir connector 86 is described as removably attached to manifold housing 46' and fluid reservoir 22, it is understood that in some examples reservoir connector 86 can be integral with one of fluid reservoir 22 and manifold 20'.

In the example shown, manifold 20' is configured to receive a single fluid reservoir 22. When fluid reservoir 22 is depleted of the mixing material, the empty fluid reservoir 22 can be removed and a fresh fluid reservoir 22 can be attached to manifold 20'. For example, where fluid reservoir 22 is attached to manifold 20 with a bayonet-style connection, fluid reservoir 22 can be removed by twisting and pulling fluid reservoir 22. Fluid reservoir 22 can then be refilled with marking fluid and reattached in the same manner, or a new fluid reservoir 22 can be attached. Moreover, manifold 20' can be attached to front housing 30 in the same manner that manifold 20 (best seen in FIGS. 2A-2B) is attached to front housing 30. As such, manifold 20' is interchangeable with manifold 20, thereby allowing the user to convert ground sprayer 10 between a single-reservoir configuration and a multiple-reservoir configuration. With ground sprayer 10 in the operating position (shown in FIG. 1B), the opening of fluid reservoir 22 is oriented downward. During operation, the marking fluid flows out of fluid reservoir 22 and through a curved pathway before entering pump 18.

Ground sprayer 10 provides several advantages. Manifold 20' and manifold 20 are interchangeable such that ground sprayer 10 can be quickly and easily converted between a single-component configuration and a multi-component configuration. In addition, fluid reservoir 22 can be attached to either manifold 20' or manifold 20. Fluid reservoir 22 is removable from manifold 20' and can be refilled and replaced or simply replaced with a full fluid reservoir 22. As such, ground sprayer 10 can be quickly refilled, reducing any downtime associated with ground sprayer 10.

Figure 6A:
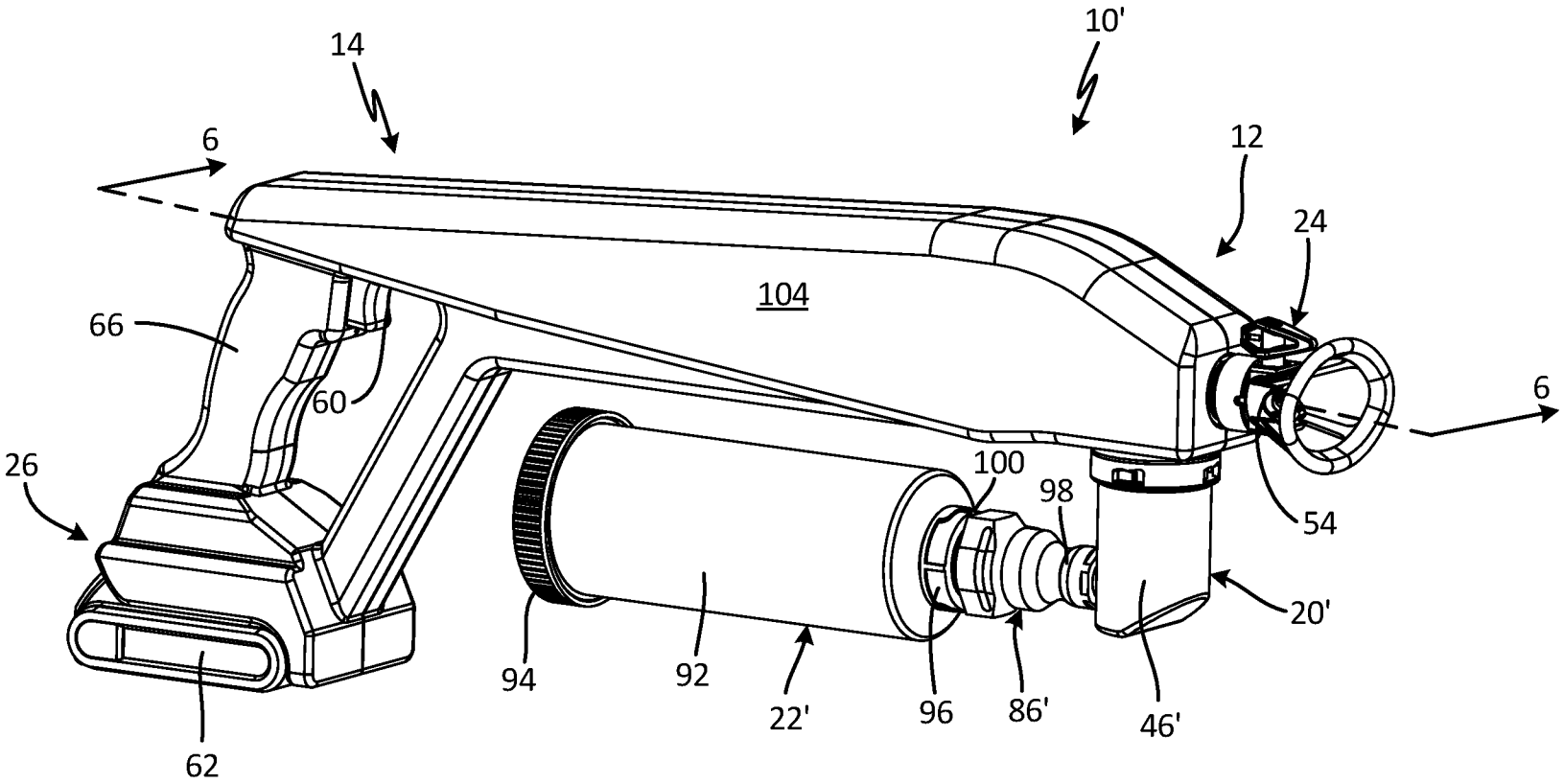
FIG. 6A is an isometric view of a handheld ground sprayer.
Figure 6B:
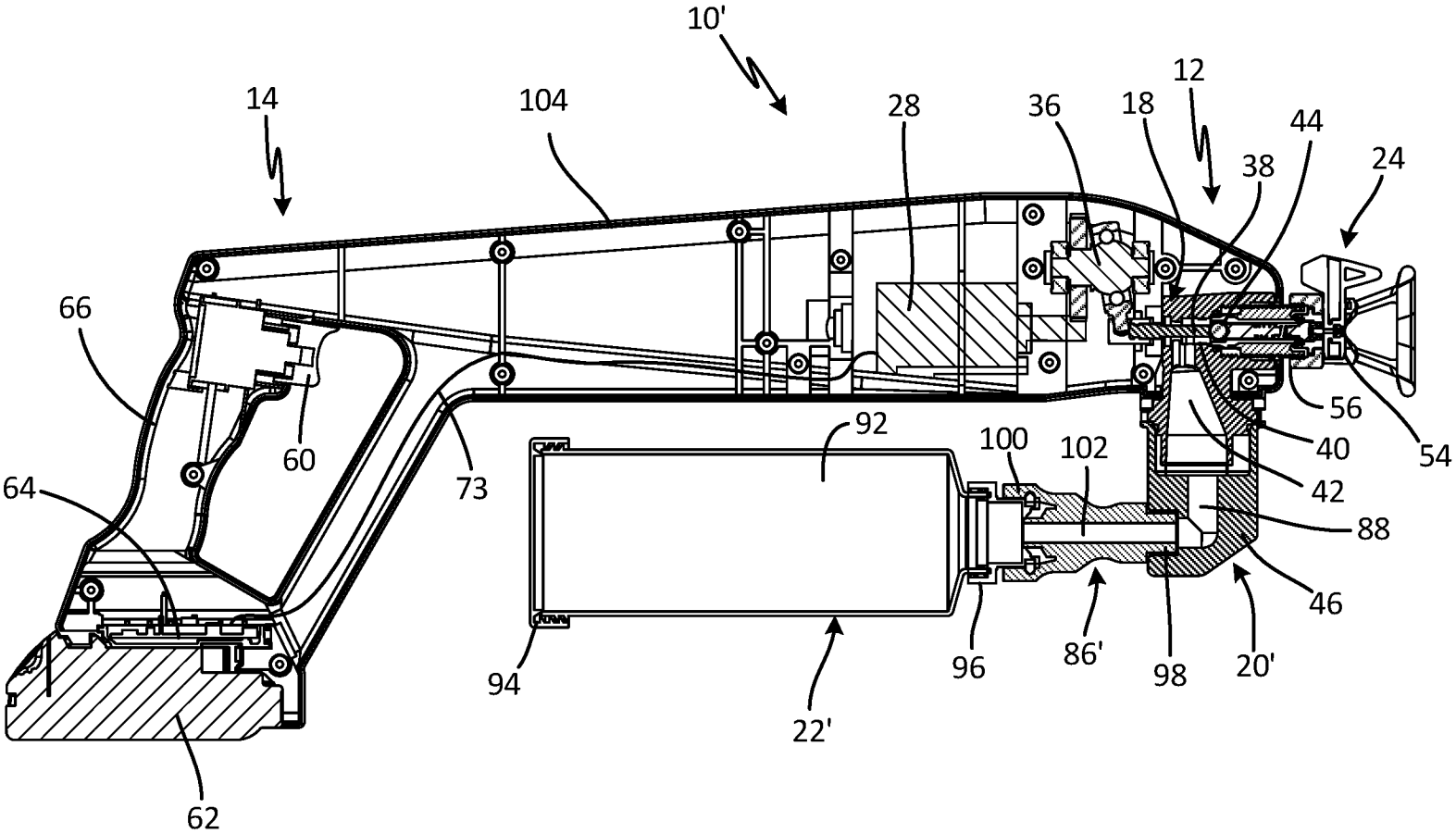
FIG. 6B is a cross-sectional view of the handheld ground sprayer of FIG. 6A taken along line 6-6 in FIG. 6A.

FIG. 6A is an isometric view of ground sprayer 10'. FIG. 6B is a cross-sectional view of ground sprayer 10' taken along line 6-6 in FIG. 6A. FIGS. 6A and 6B will be discussed together. Ground sprayer 10' includes front portion 12 and rear portion 14. Front portion 12 includes pump 18, manifold 20', fluid reservoir 22', reservoir connector 86', nozzle 24, and motor 28. Pump 18 includes drive 36, piston 38, cylinder 40, pump intake 42, and check valve 44. Manifold 20' includes manifold housing 46' and fluid passage 88. Fluid reservoir 22' includes reservoir 92, reservoir cap 94, and attachment end 96. Reservoir connector 86' includes first end 98, second end 100, and channel 102. Nozzle 24 includes spray tip 54 and tip valve 56. Rear portion 14 includes actuator 26 and handle 66. Actuator 26 includes trigger 60, battery 62, and control board 64.

Front portion 12 and rear portion 14 are supported by housing 104. Housing 104 can be of a clamshell configuration, and in some examples, housing 104 can include multiple pieces forming multiple clamshells. For example, housing 104 can include a forward housing formed separate from a rear housing. In some examples, a bridge can extend between and connect the forward housing and the rear housing, similar to ground sprayer 10. Handle 66 is formed as part of housing 104, and handle 66 is configured to be grasped by a single hand of a user. The user can fully support and operate ground sprayer 10' with the single hand grasping handle 66.

Battery 62 is disposed in rear portion 14 and supported on housing 104. Wire 73 extends from battery 62 and control board 64 to motor 28 through housing 104, and wire 73 is configured to provide power and/or commands to motor 28 in response to the user depressing trigger 60. Motor 28 is connected to drive 36 and is configured to provide a rotational output to drive 36. Drive 36 converts the rotational input from motor 28 into a linear output, and drive 36 drives piston 38 in a linear, reciprocating manner Piston 38 extends from drive 36 through cylinder 40. Pump intake 42 is configured to receive marking fluid from manifold 20' and to provide the marking fluid to cylinder 40. Check valve 44 is disposed at a downstream end of cylinder 40 to prevent marking fluid from backflowing into cylinder 40. Nozzle 24 is disposed downstream of check valve 44 and is configured to receive the marking fluid from pump 18. The marking fluid exits nozzle 24 through spray tip 54.

Manifold 20' is removably connected to housing 104 adjacent pump intake 42. Fluid passage 88 extends through manifold 20' and is configured to convey a flow of marking fluid to pump 18 from fluid reservoir 22'. Reservoir connector 86' extends between and connects manifold 20' and fluid reservoir 22'. First end 98 of reservoir connector 86' is attached to manifold 20'. Second end 100 of reservoir connector 86' is attached to attachment end 96 of fluid reservoir 22'. Channel 102 extends through reservoir connector 86' from first end 98 to second end 100. In some examples, reservoir connector 86' can include an internal one-way valve configured to prevent the marking fluid from backflowing into reservoir 92 from manifold 20'.

Reservoir cap 94 is disposed at an end of reservoir 92 opposite attachment end 96. Reservoir cap 94 is removable from reservoir 92 and allows the user to refill reservoir 92 while reservoir 92 remains attached to reservoir connector 86' and manifold 20'. In some examples, discussed in more detail below with respect to FIG. 7, reservoir cap 94 can include a vent and/or valve for allowing air to enter reservoir 92 as the marking fluid is drawn out of reservoir 92.

Attachment end 96 is removably connected to second end 100 of reservoir connector 86' with any desired connection. For example, attachment end 96 can be connected to second end 100 with a bayonet mount, a threaded connection, a press-fit connection, or any other suitable connecting type. Similarly, first end 98 of reservoir connector 86' can be connected to manifold 20' by any desired connection. For example, first end 98 can be connected to manifold 20' with a bayonet mount, a threaded connection, a press-fit connection, or any other suitable connection. Moreover, manifold 20' can be connected to housing 104 with any desired connection. For example, manifold 20' can be connected to housing 104 with a bayonet mount, a threaded connection, a press-fit connection, or any other suitable connection.

Ground sprayer 10' operates in a similar manner to ground sprayer 10 (best seen in FIGS. 2A-2B). The user depresses trigger 60, causing battery 62 to provide power to motor 28 to activate motor 28. Motor 28 provides a rotational output to drive 36, and drive 36 converts the rotational input from motor 28 into a linear output to piston 38. Drive 36 drives piston 38 in a linear, reciprocating manner, and piston 38 draws the marking fluid into cylinder 40 during a suction stroke and drives the marking fluid out of nozzle 24 during a pressure stroke. The marking fluid flows out of reservoir 92, through channel 102 in reservoir connector 86', through fluid passage 88 in manifold 20', through pump 18, and is sprayed through nozzle 24. With ground sprayer 10 in the operating position (shown in FIG. 1B), the opening of fluid reservoir 92 is oriented downward. During operation, the marking fluid flows out of fluid reservoir 92 and through a curved pathway before entering pump 18.

Ground sprayer 10' provides significant advantages. The removable connection between manifold 20' and housing 104 facilitates the conversion of ground sprayer 10 between a single-reservoir configuration and a multiple-reservoir configuration. For example, manifold 20' can be removed from housing 104 and manifold 20 (FIGS. 2A-3) can be attached to housing 104, thereby connecting multiple fluid reservoirs to pump 18. In addition, the removable connections between fluid reservoir 22 and reservoir connector 86' and between reservoir connector 86' and manifold 20 facilitate quick removal and attachment of fluid reservoirs. As such, an empty fluid reservoir can be quickly and easily replaced with a full fluid reservoir, and new colors can be easily and quickly swapped onto ground sprayer 10'.

Figure 7:
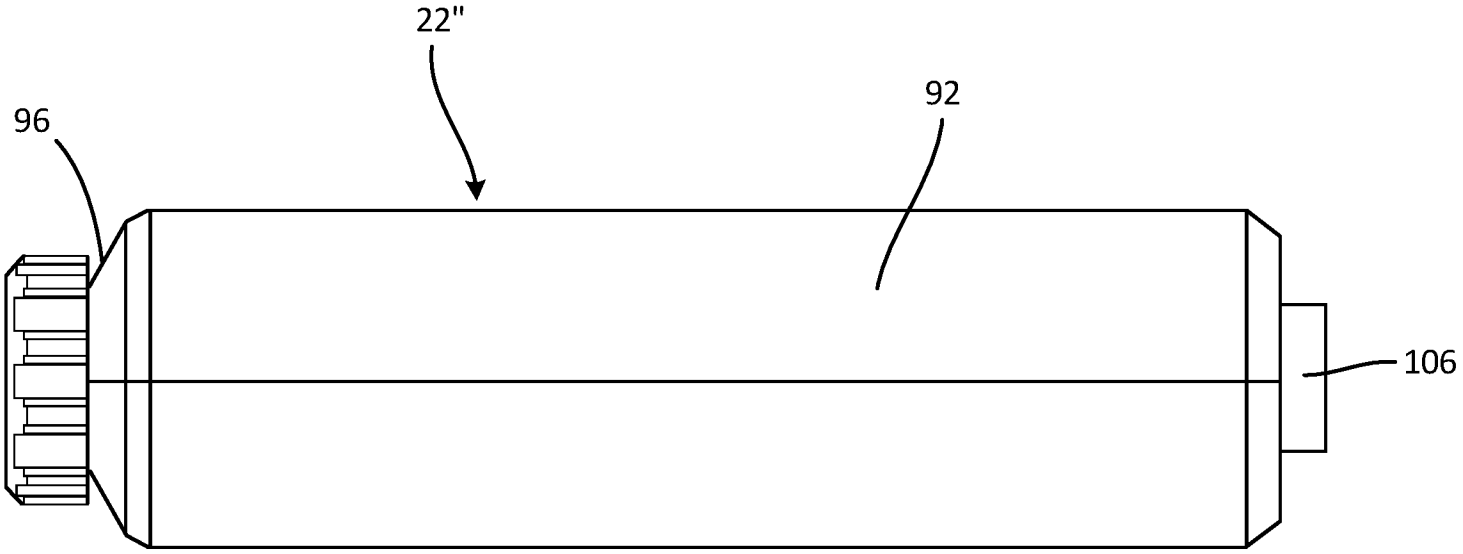
FIG. 7 is an elevation view of a fluid reservoir.
Figure 8:
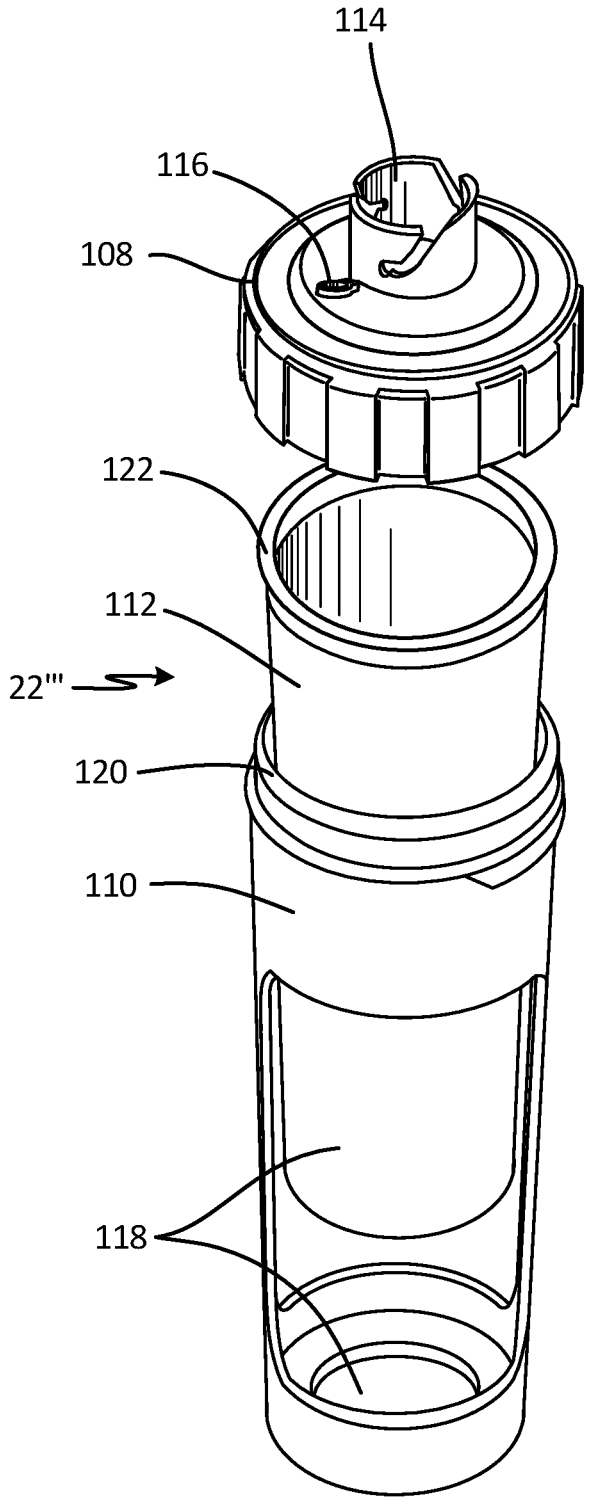
FIG. 8 is an exploded view of another fluid reservoir.

FIG. 7 is a side elevation view of fluid reservoir 22". Fluid reservoir 22" includes attachment end 96, reservoir 92, and vent 106. Attachment end 96 is disposed at a first end of reservoir 92 and vent 106 is disposed at a second end of reservoir 92. Attachment end 96 is configured to connect to a manifold, such as manifold 20 (best seen in FIGS. 2A-2B) and manifold 20' (shown in FIGS. 5-6B) and/or a reservoir connector, such as reservoir connector 86 (shown in FIG. 5) or reservoir connector 86' (FIGS. 6A-6B). Vent 106 can be integrally formed on reservoir 92. Vent 106 can be adjustable between an open position and a closed position, and vent 106 is configured to allow air to enter reservoir 92 as marking fluid is drawn out of reservoir 92 during spray operations.

During operation, the marking fluid is drawn out of reservoir 92 through attachment end 96. To facilitate the flow of material out of reservoir 92, vent 106 allows air to flow into reservoir 92 to replace the volume of marking fluid flowing out of reservoir 92. While in the operating orientation (FIG. 1B), reservoir 92 is oriented such that vent 106 is disposed vertically above attachment end 96. Gravity thus causes the marking fluid to pool at attachment end 96. With the marking fluid pooling at attachment end 96, the air introduced to reservoir 92 through vent 106 is prevented from entering the pump assembly by the marking fluid itself. As such, positioning vent 106 at the end opposite attachment end 96 eliminates any concerns regarding spitting during application of the marking fluid.

Vent 106 can be of any suitable configuration for allowing air to enter reservoir 92 during operation. In some examples, vent 106 can be a one-way valve, such as a ball valve, a reed valve, a poppet valve, or any other suitable one-way valve. For example, as the marking fluid is drawn out of reservoir 92, a vacuum condition can form in reservoir 92. The vacuum condition can cause the one-way valve to shift open to allow air to flow into reservoir 92, thereby relieving the vacuum condition and allowing the marking fluid to flow more freely out of reservoir 92. In other examples, vent 106 can be a manual bleed valve that the user can adjust between an open position, for allowing air to flow into reservoir 92, and a closed position, preventing air from flowing into reservoir 92. Where vent 106 is a bleed valve, the user can shift the valve to the open position during operation and can close the valve to prevent marking fluid from leaking through vent 106 at other times.

Fluid reservoir 22" provides several advantages. Vent 106 allows air to flow into reservoir 92 during operation to facilitate a smooth flow of marking fluid out of reservoir 92. Where vent 106 is a one-way valve, vent 106 can automatically shift to the open position to allow the air to flow into reservoir 92. In addition, vent 106 is positioned at an end of reservoir 92 opposite attachment end 96. The marking fluid is denser than the air, so the air remains at the end of reservoir 92 opposite attachment end 96, when reservoir 92 is in the operational orientation, thereby preventing the air from being drawn into pump 18. As such, the position of vent 106 prevents spitting during application of the marking fluid.

FIG. 8 is an exploded view of fluid reservoir 22'. Fluid reservoir 22'" includes lid 108, cup 110, and collapsible liner 112. Lid 108 includes connector 114 and vent 116. Cup 110 includes cut out portions 118 and liner securing portion 120. Collapsible liner 112 includes lip 122.

Collapsible liner 112 is configured to store a volume of marking fluid prior to application by a ground sprayer, such as ground sprayer 10 (best seen in FIGS. 2A-2B) and ground sprayer 10' (best seen in FIGS. 6A-6B). Collapsible liner 112 is disposed in cup 110. Lip 122 of collapsible liner 112 extends over liner securing portion 120 of cup 110. Lid 108 is removably secured to cup 110, for example by a bayonet mount, a threaded connection, or press-fit connection. With lid 108 attached to cup 110, lip 122 is captured between lid 108 and liner securing portion 120, such that collapsible liner 112 is secured within cup 110. Cup 110 can be formed of a rigid material, such that cup 110 does not collapse during operation. With cup 110 formed of the rigid material, cup 110 can be secured on the ground sprayer by a reservoir support, such as reservoir support 32 (best seen in FIG. 2A). Cut out portions 118 extend through cup 110 and allow a user access to collapsible liner 112 when collapsible liner 112 is secured within cup 110.

Connector 114 is formed in lid 108 and is configured to attach to a manifold, such as manifold 20 (best seen in FIGS. 2A-2B) and manifold 20' (best seen in FIG. 5). As shown, connector 114 can be a bayonet mount. It is understood, however, that reservoir connector 86 can be of any suitable configuration for removably connecting fluid reservoir 22'" to the manifold, such as a threaded connection or a press-fit connection, among others. Vent 116 is formed on lid 108 and is configured to allow for the removal of air from fluid reservoir 22''' prior to operation.

During operation, collapsible liner 112 is filled with a supply of marking fluid and is positioned in cup 110, with lip 122 overlapping liner securing portion 120. Lid 108 is attached to cup 110, thereby securing collapsible liner 112 in place with lip 122 captured between lid 108 and liner securing portion 120. Fluid reservoir 22 is attached to the manifold by attaching connector 114 to the manifold. With fluid reservoir 22 attached to the manifold, the user can squeeze collapsible liner 112 through cut out portions 118 of cup 110. Squeezing collapsible liner 112 forces any air within collapsible liner 112 out of vent 116. Once the air has been purged from collapsible liner 112, fluid reservoir 22'' is primed for operation. In some examples, vent 116 can include a one-way valve configured to open in response to the pressure generated by squeezing collapsible liner 112, such as a ball check valve, a poppet valve, or a reed valve, among others. In other examples, vent 116 can include a manual open/close valve that can be manipulated by the user to prime fluid reservoir 22'. It is understood, however, that vent 116 can be of any other suitable configuration for purging air from collapsible liner 112 prior to operation. Collapsible liner 112 is configured to collapse as the marking fluid is drawn from fluid reservoir 22', thereby providing the user with a visual indication of the volume of marking fluid remaining in fluid reservoir 22'.

Fluid reservoir 22' provides several advantages. The air can be removed from fluid reservoir 22' by squeezing collapsible liner 112, thereby preventing spitting from occurring during application of the marking fluid. Collapsible liner 112 is configured to collapse as the marking fluid is drawn out of collapsible liner 112. As such, additional air does not need to be vented into collapsible liner 112 to replace material, thereby simplifying the fluid supply. Moreover, the shrinking collapsible liner 112 provides a visual indication to the user regarding the volume of marking fluid remaining in fluid reservoir 22'''. In addition, fluid reservoir 22''' is suitable for multiple uses with a variety of marking fluids, such as paints of different colors, by attaching a new collapsible liner 112, eliminating any concerns regarding contamination due to the previous material that was in the fluid supply.

Figure 9A:
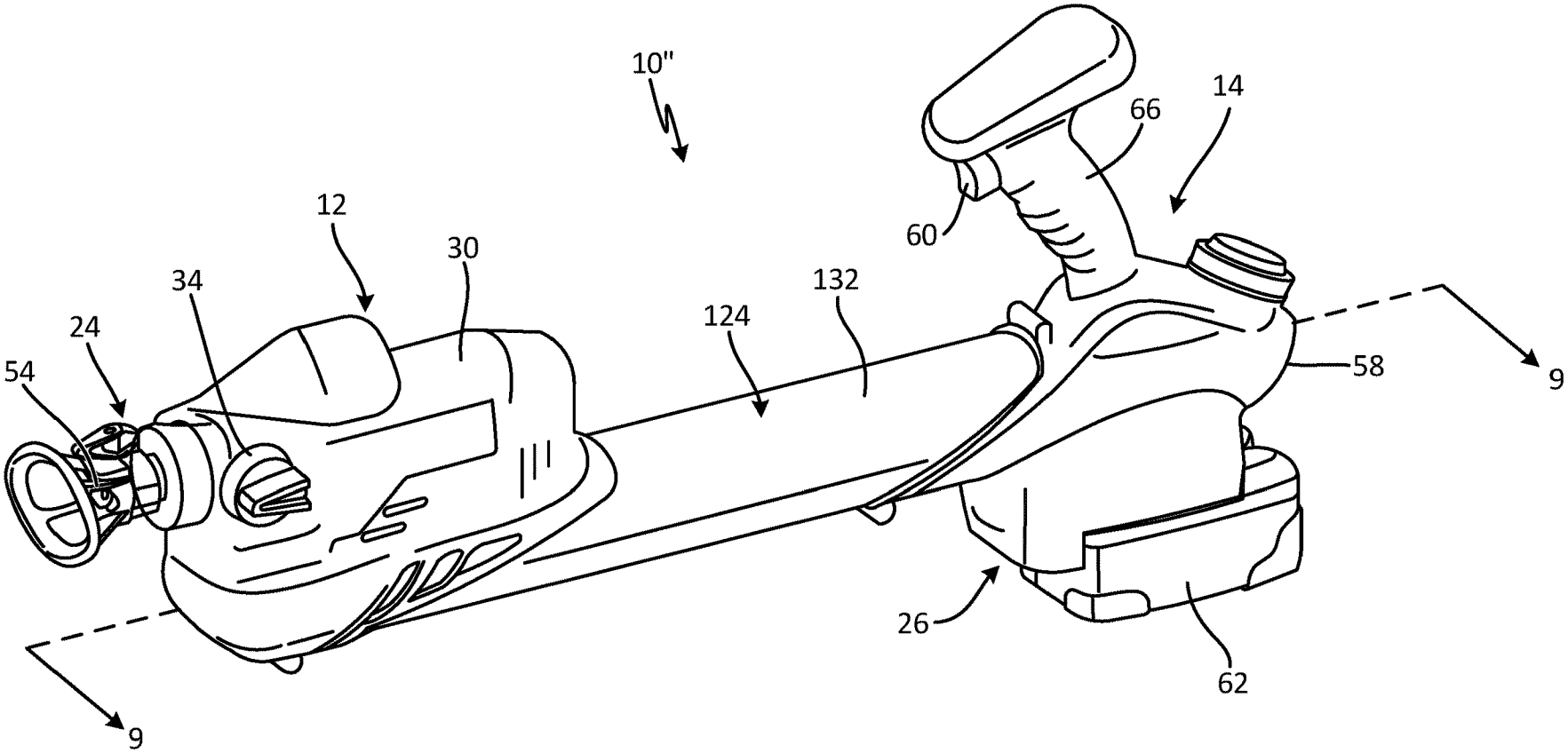
FIG. 9A is an isometric view of another handheld ground sprayer.
Figure 9B:
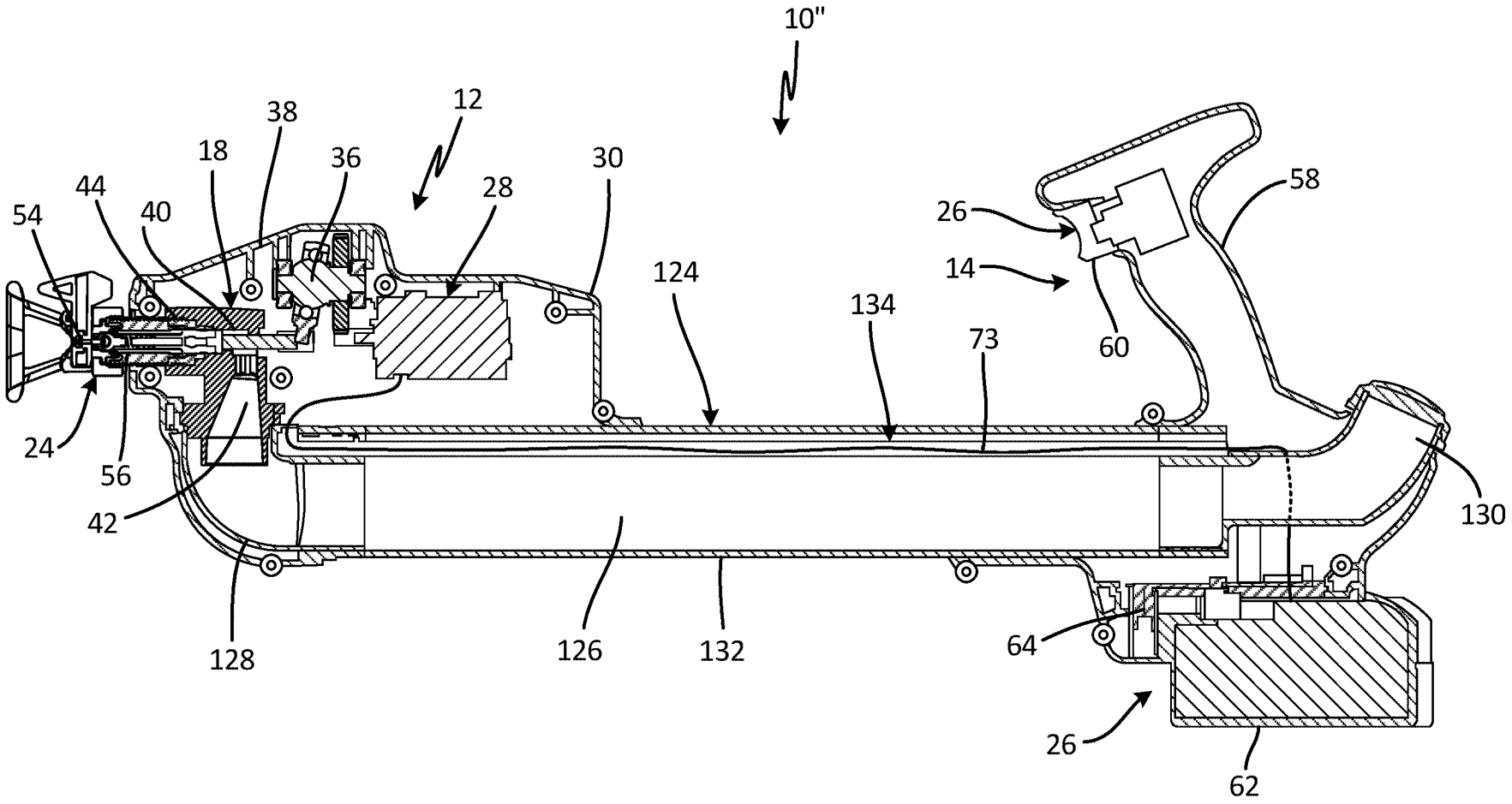
FIG. 9B is a cross-sectional view of the handheld ground sprayer of FIG. 9A taken along line 9-9 in FIG. 9A.

FIG. 9A is an isometric view of ground sprayer 10''. FIG. 9B is a cross-sectional view of ground sprayer 10'' taken along line 9-9 in FIG. 9A. Ground sprayer 10 includes front portion 12, rear portion 14, connector 124, and fluid reservoir 126. Front portion 12 includes pump 18, nozzle 24, motor 28, front housing 30, control switch 34, and inlet connector 128. Pump 18 includes drive 36, piston 38, cylinder 40, pump intake 42, and check valve 44. Nozzle 24 includes spray tip 54 and tip valve 56. Rear portion 14 includes actuator 26, rear housing 58, and fill port 130. Actuator 26 includes trigger 60, battery 62, and control board 64. Rear housing 58 includes handle 66. Connector 124 includes bridge 132 and wire tube 134.

Connector 124 extends between and connects front portion 12 and rear portion 14. A first end of bridge 132 can be secured to front housing 30 and a second, opposite end of bridge 132 can be secured to rear housing 58. Front housing 30 and rear housing 58 can be attached to bridge 132 in any suitable manner, such as by screws, glue, and/or pinching. In some examples, front housing 30 and rear housing 58 are each of a clamshell configuration. Bridge 132 is hollow and forms a portion of fluid reservoir 126. Fluid reservoir 126 is configured to store a volume of the marking fluid prior to application and extends from fill port 130, through bridge 132, and into inlet connector 128. Bridge 132 is configured to structurally support front portion 12 and rear portion 14. Bridge 132 can be a metal or polymer tube, and bridge 132 can further be a transparent or translucent material to allow the user to visually determine the volume of marking fluid remaining in fluid reservoir 126.

Handle 66 is integrally formed on rear housing 58 and is configured to be grasped by a single hand of a user. The user can fully support and operate ground sprayer 10 with the single hand grasping handle 66. Trigger 60 extends from handle 66 and the user can activate ground sprayer 10 by depressing trigger 60. Battery 62 can interface with the rear housing 58 both to make an electrical connection for powering the ground sprayer 10 and to lock battery 62 in place by structurally fixing battery 62 to the rear portion 14. After use, battery 62 can be slid out of the locked arrangement with rear housing 58 for removal, recharging, and recoupling with rear portion 14. Control board 64 is disposed in rear housing 58 and includes circuitry for managing power from battery 62. While actuator 26 is shown as including battery 62, it is understood that any suitable power source can be used, for example an electrical cord and plug for plugging into an electrical outlet and/or cord, or a tank of compressed air or a hose supplying compressed air.

Motor 28 is disposed in front housing 30 and is connected to drive 36. Piston 38 extends from drive 36 into cylinder 40, and is configured to draw the marking fluid from fluid reservoir 126 and to drive the marking fluid out of ground sprayer 10 through nozzle 24. Pump intake 42 is disposed within front housing 30 and at least partially defines cylinder 40. Check valve 44 is disposed downstream of piston 38 and is configured to prevent the marking fluid from backflowing into cylinder 40 from nozzle 24. While pump 18 is described as a piston pump, it is understood that pump 18 can be of any suitable configuration, such as a diaphragm pump or another positive displacement pump.

Nozzle 24 is disposed downstream of pump 18 and is configured to apply the marking fluid to the ground. Tip valve 56 receives the marking fluid from pump 18 and the marking fluid is sprayed out of front portion 12 through spray tip 54. Spray tip 54 includes an orifice to atomize the marking fluid and to generate a desired spray pattern. For example, spray tip 54 can include a carbide orifice configured to provide a fan pattern.

Wire tube 134 extends through bridge portion 72 between rear housing 58 and front housing 30. Wire 73 extends from control board 64 to battery 62 through wire tube 134. Wire tube 134 is configured to fluidly isolate wire 73 from the marking fluid disposed within fluid reservoir 126. Fill port 130 extends through rear housing 58 and can be connected to a rear end of bridge portion 72. Fill port 130 is configured to receive the marking fluid when ground sprayer 10 is being filled. Fill port 130 extends out of rear housing 58 rearward of handle 66, and such a position allows the user to refill fluid reservoir 126 while gripping handle 66 and while some marking fluid remains in fluid reservoir 126, as the force of gravity causes the remaining marking fluid to pool proximate front portion 12. Manifold 20 is disposed in front housing 30 and extends between and connects bridge portion 72 and pump 18.

Fluid reservoir 126 spans from rear portion 14, through connector 124, and into front portion 12. At least a portion of fluid reservoir 126 is disposed within front housing 30 and rear housing 58. Bridge 132 defines fluid reservoir 126 between front housing 30 and rear housing 58. In some examples, bridge 132 can be enclosed in a housing extending between the front housing 30 and the rear housing 58.

Ground sprayer 10" operates in a similar manner to ground sprayer 10 (best seen in FIGS. 2A-2B) and ground sprayer 10' (shown in FIGS. 6A-6B). Pump 18 draws the marking fluid into pump intake 42 from fluid reservoir 126. The user can grasp handle 66 and orient ground sprayer 10 in the operational position (shown in FIG. 1B). The user depresses trigger 60, causing motor 28 to provide a rotational output to drive 36. Drive 36 converts the rotational motion of motor 28 into linear, reciprocating movement of piston 38, and piston 38 draws fluid from fluid reservoir 126 during a suction stroke and drives the fluid out of nozzle 24 during a pressure stroke. Fluid reservoir 126 is oriented such that gravity causes the fluid to flow towards pump 18 with ground sprayer 10" in the operating position. After dispensing the marking fluid, fluid reservoir 126 can be refilled by removing a cap from fill port 130, pouring new marking fluid into fluid reservoir 126 through fill port 130, and reattaching the cap to seal fill port 130.

Ground sprayer 10" provides several advantages. Ground sprayer 10" provides an airless spray of marking fluid without requiring any additional propellants. In the operating orientation, gravity causes the marking fluid to flow towards front portion 12, minimizing any risk of electrical shorting caused by the marking fluid. Fluid reservoir 126 is refillable, such that ground sprayer 10" can be used across a variety of applications and with a variety of marking fluids.

Although the present invention has been described with reference to preferred embodiments, workers skilled in the art will recognize that changes may be made in form and detail without departing from the spirit and scope of the invention.

The invention claimed is:

1. A handheld ground sprayer comprising:

a front portion comprising:

a front housing;

a first fluid reservoir configured to store a supply of marking fluid, wherein the first fluid reservoir is elongate along a reservoir axis; and a pump having a pump body and a piston configured to reciprocate along a pump axis to pump the marking fluid through the pump body, wherein the pump body is at least partially disposed in the front housing, and wherein the pump is fluidly connected to the fluid reservoir and a nozzle, and wherein the pump is configured to draw the marking fluid from the fluid reservoir to a pump chamber and drive the marking fluid from the pump chamber to the nozzle; and a rear portion connected to the front portion, the rear portion comprising:

a rear housing having a handle configured to be grasped by a user; and an actuator supported by the rear housing, the actuator configured to selectively power the pump to drive the marking fluid from the fluid reservoir to the nozzle; and a first manifold including a curved flowpath fluidly connecting the first fluid reservoir and the pump, wherein the rear portion is configured to be disposed above the front portion with the ground sprayer in an operating position;

wherein the flowpath is configured to redirect the fluid, with the ground sprayer in the operating position, from a substantially vertical flow at an interface between the reservoir and the first manifold to a substantially horizontal flow at an interface between the first manifold and the pump; and wherein the pump axis is oriented substantially vertically with the ground sprayer in the operating position.

2. The handheld ground sprayer of claim 1, wherein the front portion further comprises:

a motor connected to the pump and configured to provide motive power to the pump.

3. The handheld ground sprayer of claim 2, wherein the actuator comprises:

a power source connected to the motor; and a trigger connected to the power source and configured to activate and deactivate the power source.

4. The handheld ground sprayer of claim 3, wherein the power source comprises a battery mounted on the rear housing.

5. The handheld ground sprayer of claim 3, further comprising:

a hollow bridge extending between and connecting the front portion and the rear portion; and a wire extending from the power source to the motor through the hollow bridge and configured to convey power to the motor from the power source.

6. The handheld ground sprayer of claim 5, wherein the hollow bridge is aligned on a spray axis of the handheld ground sprayer, the spray axis extending through a nozzle configured to receive the marking fluid from the pump and to spray the marking fluid.

7. The handheld ground sprayer of claim 1, further comprising:

a reservoir support supported on the front housing and attached to the fluid reservoir, wherein the reservoir support is configured to support the fluid reservoir relative to the front housing.

8. The handheld ground sprayer of claim 1, further comprising:

a second fluid reservoir connected to the first manifold, such that both the first fluid reservoir and the second fluid reservoir are simultaneously connected to the first manifold.

9. The handheld ground sprayer of claim 8, wherein the first manifold comprises:

a manifold housing connected to the front housing;

a selector valve disposed in the first manifold and configured to fluidly connect one of the first fluid reservoir and the second fluid reservoir to the pump and to concurrently fluidly disconnect the other one of the first fluid reservoir and the second fluid reservoir from the pump assembly.

10. The handheld ground sprayer of claim 9, wherein the first manifold further comprises:

a selector knob disposed external to the manifold housing and connected to the selector valve, the selector knob configured to manipulate a position of the selector valve.

11. The handheld ground sprayer of claim 1, further comprising:

a second manifold removable from the front portion and configured to connect to a plurality of fluid reservoirs simultaneously and to convey marking fluid from one of the plurality of the fluid reservoirs to the pump;

wherein the first manifold is configured to connect to a maximum of one fluid reservoir.

12. The handheld ground sprayer of claim 1, wherein the pump is a piston pump.

13. The handheld ground sprayer of claim 1, further comprising:

a connector extending between and connecting the front portion and the rear portion, wherein the connector is fixed relative to one of the front portion and the rear portion and is movable relative to the other one of the front portion and the rear portion such that a distance between the front portion and the rear portion is adjustable.

14. A handheld ground sprayer comprising:

a front portion comprising:

a nozzle configured to spray a marking fluid, a spray axis extending through the nozzle;

a pump fluidly connected to the nozzle and configured to drive the marking fluid through the nozzle;

a motor connected to the pump and configured to power the pump;

a manifold disposed upstream of the pump; and a fluid reservoir removably mounted to the manifold, the fluid reservoir configured to store a supply of the marking fluid and to provide the marking fluid to the manifold through a reservoir opening of the fluid reservoir;

a rear portion including:

a handle;

a trigger extending from the handle; and a power source configured to activate the motor in response to the trigger being depressed;

a support extending between and connecting the front portion and the rear portion;

wherein a void is disposed within the support between the front portion and the rear portion; and wherein the front portion is disposed on a first side of a dividing line orthogonal to the spray axis and extending through the support, and the rear portion is disposed on a second side of the dividing line opposite the first side.

15. The handheld ground sprayer of claim 14, wherein a spray axis on which the pump, the nozzle, and the support are aligned is configured to be vertically oriented with the ground sprayer in an operating position such that the rear portion is disposed vertically above the front portion.

16. The handheld ground sprayer of claim 15, further comprising:

a reservoir connector extending between and connecting the fluid reservoir and the manifold.

17. The handheld ground sprayer of claim 15, wherein the fluid reservoir comprises:

a lid having an attachment portion and a vent extending through the lid, the attachment portion configured to connect to the manifold;

a cup attached to the lid, the cup including at least one cutout; and a collapsible liner disposed within the cup and configured to store the marking fluid;

wherein a lip of the collapsible liner is secured between the lid and the cup.

18. The handheld ground sprayer of claim 15, wherein the reservoir opening is oriented vertically downward in the operating position such that the marking fluid, after passing through the reservoir opening, flows through a curved pathway prior to entering the pump.

19. The handheld ground sprayer of claim 1, wherein the first manifold includes an elbowed flowpath.

20. A handheld ground sprayer comprising:

a front portion comprising:

a first fluid reservoir configured to store a supply of marking fluid; and a pump having a pump body and a piston configured to reciprocate along a pump axis to pump the marking fluid through the pump body, wherein the pump body is at least partially disposed in a front housing, wherein the pump is fluidly connected to the fluid reservoir and a nozzle, and wherein the pump is configured to draw the marking fluid from the fluid reservoir to a pump chamber and drive the marking fluid from the pump chamber to the nozzle; and a rear portion connected to the front portion and spaced in a first axial direction from the front portion, the rear portion comprising:

a rear housing having a handle configured to be grasped by a user; and an actuator supported by the rear housing, the actuator configured to selectively power the pump to drive the marking fluid from the fluid reservoir to the nozzle; and a first manifold fluidly connecting the first fluid reservoir and the pump and supporting the first fluid reservoir;

wherein the rear portion is configured to be disposed above the front portion with the ground sprayer in an operating position;

wherein the pump axis is oriented substantially vertically with the ground sprayer in the operating position; and wherein the reservoir is elongate along a reservoir axis and extends in the first axial direction from the manifold; and wherein the nozzle is configured to emit spray fluid in a second axial direction opposite the first axial direction.

* * * * *